US008826710B2

(12) United States Patent
Dickhans et al.

(10) Patent No.: US 8,826,710 B2
(45) Date of Patent: Sep. 9, 2014

(54) LOCK CYLINDER WITH OFFSET PIN

(75) Inventors: William J. Dickhans, Colorado Springs, CO (US); Paul O. Gardner, Colorado Springs, CO (US); Misty G. Jackson, Colorado Springs, CO (US)

(73) Assignee: Schlage Lock Company, Carmel, IN (US)

( * ) Notice: Subject to any disclaimer, the term of this patent is extended or adjusted under 35 U.S.C. 154(b) by 0 days.

(21) Appl. No.: 13/295,917

(22) Filed: Nov. 14, 2011

(65) Prior Publication Data

US 2012/0055215 A1 Mar. 8, 2012

Related U.S. Application Data

(62) Division of application No. 11/619,774, filed on Jan. 4, 2007, now Pat. No. 8,056,379.

(51) Int. Cl.
*E05B 27/00* (2006.01)

(52) U.S. Cl.
CPC ..... *E05B 27/0053* (2013.01); *E05B 27/0017* (2013.01); *E05B 27/0057* (2013.01); *E05B 27/005* (2013.01)
USPC ..... 70/493; 70/375; 70/384

(58) Field of Classification Search
USPC ..... 70/358, 493–496, 420, 453, 375, 347, 70/346, 356, DIG. 15
See application file for complete search history.

(56) References Cited

U.S. PATENT DOCUMENTS

| | | | | |
|---|---|---|---|---|
| 2,087,554 | A | | 7/1937 | Schoorel |
| 3,059,462 | A | * | 10/1962 | Check ..... 70/384 |
| 3,099,151 | A | | 7/1963 | Schlage |
| 3,431,757 | A | | 3/1969 | Hori |
| 3,479,849 | A | | 11/1969 | Check |
| 3,590,615 | A | | 7/1971 | Schultz |
| 4,196,604 | A | | 4/1980 | Vorob |
| 4,221,121 | A | | 9/1980 | Tietz |
| 4,222,252 | A | | 9/1980 | Tietz |
| 4,580,425 | A | | 4/1986 | Smith |
| 4,875,352 | A | | 10/1989 | Smallegan et al. |
| 5,079,936 | A | | 1/1992 | Stefanek |
| 5,088,306 | A | | 2/1992 | Field |
| 5,138,856 | A | | 8/1992 | Chyun |
| 5,375,444 | A | | 12/1994 | Smith |

(Continued)

FOREIGN PATENT DOCUMENTS

| | | |
|---|---|---|
| DE | 10333211 | 3/2005 |
| DE | 102005001085 | 7/2006 |
| EP | 1418294 | 5/2004 |
| WO | WO 2004029390 | 4/2004 |

*Primary Examiner* — Suzanne Barrett
(74) *Attorney, Agent, or Firm* — Michael Best & Friedrich LLP

(57) ABSTRACT

A method of re-keying a lock cylinder. The method includes providing a housing including outer pins, a plug rotatably engaged within the housing and having a key slot and inner pins configured to align with the outer pins, and an engagement member inserted into the plug as a separate piece such that the engagement member engages one or more originally engaged inner pins to space each of the engaged inner pins a distance from a pin resting surface defined by the key slot. The method also includes modifying the engagement member, and inserting the modified engagement member into the plug so that the engagement member engages one or more newly engaged inner pins different from the originally engaged inner pins to space each of the newly engaged inner pins a distance from the pin resting surface.

19 Claims, 20 Drawing Sheets

(56) References Cited

U.S. PATENT DOCUMENTS

| | | | |
|---|---|---|---|
| 5,475,998 | A | 12/1995 | Raskevicius et al. |
| 5,893,285 | A | 4/1999 | Athanassiou |
| 5,894,750 | A | 4/1999 | Liaw |
| 5,931,036 | A | 8/1999 | Keller |
| 5,966,971 | A | 10/1999 | Keller |
| 6,477,876 | B1 | 11/2002 | Kim |
| 6,601,419 | B2 | 8/2003 | Huang et al. |
| 6,860,131 | B2 | 3/2005 | Armstrong et al. |
| 7,114,357 | B2 | 10/2006 | Armstrong et al. |
| 2003/0037579 | A1 | 2/2003 | Wu |
| 2004/0172995 | A1 | 9/2004 | Haggstrom |
| 2005/0172688 | A1 | 8/2005 | Widen |
| 2005/0235714 | A1 | 10/2005 | Lindstrom |
| 2006/0096345 | A1 | 5/2006 | Chen |
| 2006/0144104 | A1 | 7/2006 | Chang |

* cited by examiner

LOCK CYLINDER WITH OFFSET PIN

CROSS-REFERENCE TO RELATED APPLICATIONS

This application claims priority to U.S. patent application Ser. No. 11/619,774, filed Jan. 4, 2007, the entire contents of which are hereby incorporated by reference.

BACKGROUND

The present invention relates to a lock cylinder. More particularly, the present invention relates to a lock cylinder that is mounted in a door and that includes a housing and a plug.

Generally, lock cylinders include a housing and a plug that define respective pin chambers to receive pin pairs. The pin pairs include outer pins substantially disposed within the housing, and inner pins disposed within the plug. Springs are often used to bias the pin pairs toward a key slot defined in the plug. More specifically, the springs are engaged with the outer pins, which in turn engage the inner pins and force the inner pins into the key slot. In the absence of a correct or proper key, the outer pins are partially disposed in the plug and block rotation of the plug within the housing.

The plug is rotatable relative to the housing in most conventional lock cylinders. A shear line is defined where the plug and the housing come together. When a proper key is inserted into the key slot, the inner pins are moved and, as a result, move the respective outer pins. The ends where the inner pins and the outer pins contact each other are aligned with the shear line upon insertion of the proper key, and allow the plug to be turned to a locked or unlocked position. In other words, the proper key will move the inner and outer pins such that the outer pins are disposed completely in the housing, and the inner pins are disposed completely in the plug.

In some lock cylinders, the inner pins engage a surface defined by the key slot such that the portions of the inner pins that are engaged by a key are at the same plane (i.e., extend the same distance into the key slot). Inner pins positioned along the same plane within the key slot may provide easy access to each pin in the lock cylinder. As such, it may be possible to unlock the lock cylinder without using a proper key.

When re-keying a lock cylinder using a typical lock cylinder design, appropriate inner pins must be replaced so that a new key can be used to operate the lockset. The process usually employs special tools and requires maintaining an inventory so that the inner pins can be exchanged with new inner pins. These inner pins are relatively small, and can become lost during the re-keying process.

SUMMARY

In one embodiment, the invention provides a lock cylinder for a door that includes a housing and a plug. The housing includes a wall that defines a hollow portion, and a pin portion that defines a first pin chamber that is configured to receive a first pin. The plug includes a body rotatably housed within the hollow portion of the housing. A key slot is defined in the body in part by a pin resting surface, and a second pin chamber is disposed in the body and in communication with the key slot. A second pin is disposed within the second pin chamber and is configured to engage the pin resting surface. An engagement member is disposed within the body as a separate piece, and engaged with the second pin to space the second pin a distance from the pin resting surface in the absence of a key in the slot.

In another embodiment, the invention provides a lock cylinder for a door that includes a housing and a plug. The housing includes a wall that defines a hollow portion, and a pin portion that defines at least two outer pin chambers. Each of the outer pin chambers is configured to receive a respective outer pin. The plug includes a body that is rotatably housed within the hollow portion of the housing. A key slot is disposed at least partially through the body, and is defined in part by a pin resting surface. The plug further includes at least two inner pin chambers disposed within the body and in communication with the key slot. Each of the inner pin chambers is configured to selectively align with a respective one of the outer pin chambers. An inner pin is disposed in each of the inner pin chambers, and each inner pin extends partially into the key slot. Each inner pin is configured to be engaged by a key inserted into the key slot. An engagement member disposed within the body as a separate piece, and is engaged with at least one of the inner pins such that the inner pins extend different distances into the key slot in the absence of a key in the slot.

In yet another embodiment, the invention provides a method of re-keying a lock cylinder. The method includes providing a housing including outer pins, a plug rotatably engaged within the housing and having a key slot and inner pins configured to align with the outer pins, and an engagement member inserted into the plug as a separate piece such that the engagement member engages one or more originally engaged inner pins to space each of the engaged inner pins a distance from a pin resting surface defined by the key slot. The method further includes modifying the engagement member, and inserting the modified engagement member into the plug. Insertion of the modified engagement member into the plug engages one or more newly engaged inner pins different from the originally engaged inner pins to space each of the newly engaged inner pins a distance from the pin resting surface.

In yet another embodiment, the invention provides a method of manufacturing a lock cylinder. The method includes providing a housing including outer pins, and a plug rotatably engaged within the housing. The plug includes a key slot and inner pins that are configured to align with the outer pins. The method also includes providing an engagement member that can be inserted into the plug as a separate piece, and that can be selectively provided with a respective engagement portion for each of the outer pins. The engagement member is provided with a selected set of engagement portions. The method further includes inserting the engagement member into the plug so that the selected engagement portions engage the respective inner pins, and spacing each of the engaged inner pins a distance from a pin resting surface defined by the key slot.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
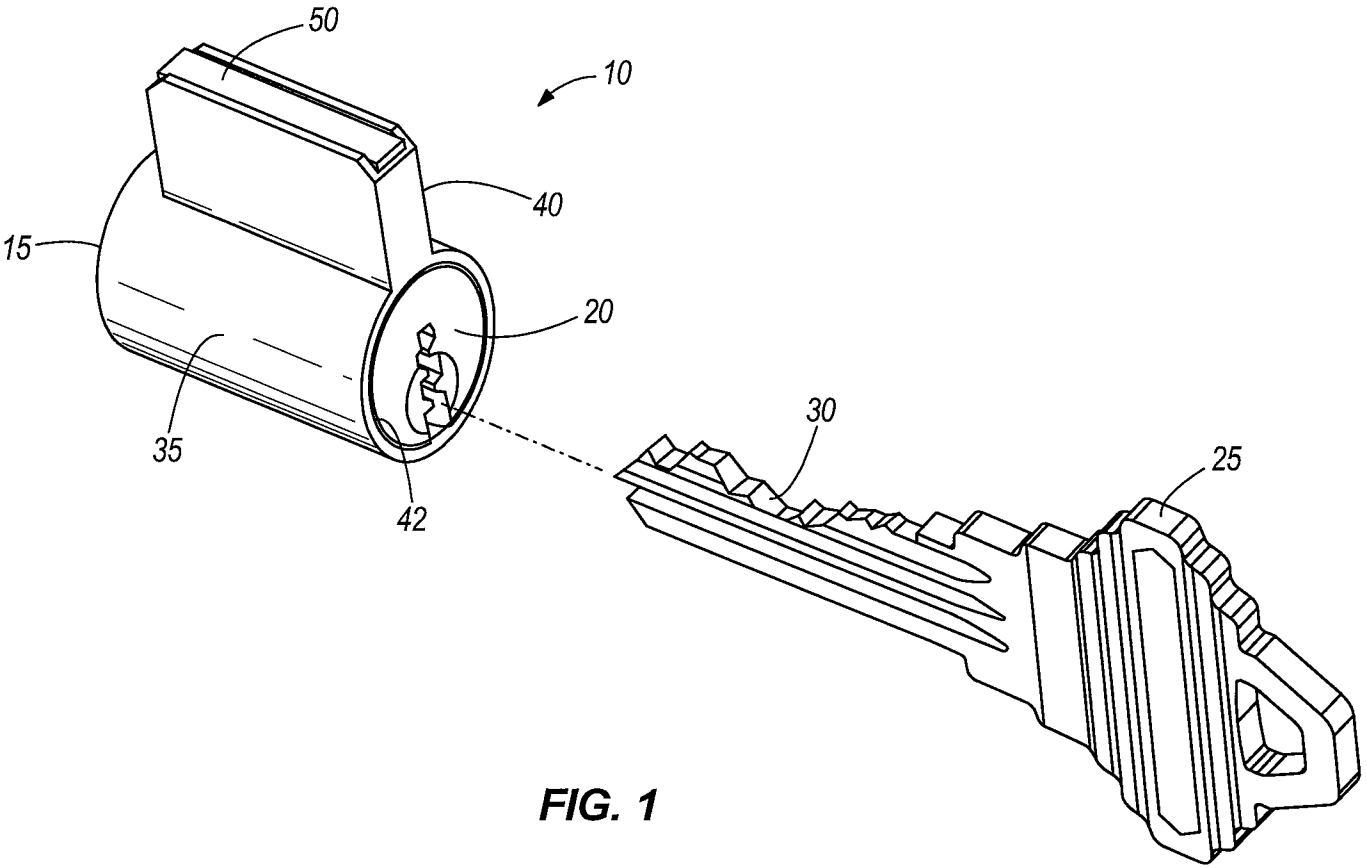
FIG. 1 is a perspective view of a lock cylinder and a key.

FIG. 1 shows a lock cylinder 10 for use with structures (e.g., door, access panel, portable locks, etc.) that may be locked and unlocked. Hereinafter, the term "door" shall be used to represent all such lockable structures and shall not be construed to limit the invention's application solely to doors. The lock cylinder 10 includes a housing 15 and a plug 20 configured to be selectively rotatable within the housing 15 using a key 25 that has pin engaging portions 30. The housing 15 includes a wall 35 and a pin portion 40. The wall 35 is substantially cylindrical and defines a hollow portion 42 that is configured to receive the plug 20. The housing 15 is typically fixed relative to the door, and the plug 20 is movable relative to the housing 15 between a locked position and an unlocked position. The plug is typically connected to a driver bar (not shown) or other structure for moving a latch relative to the door to lock or unlock the door. Such arrangements are well known in the art.

Figure 16:
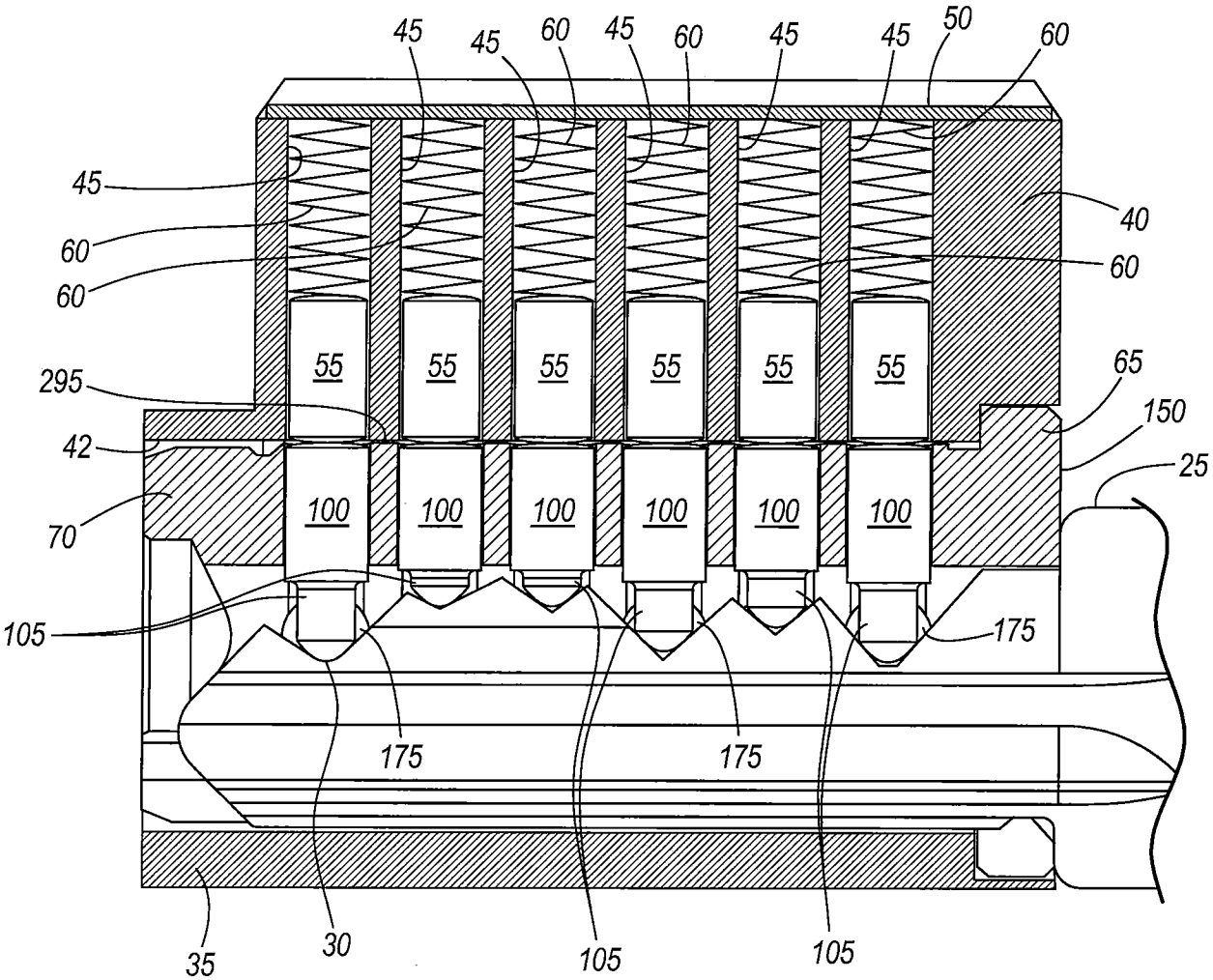
FIG. 16 is a section view of the lock cylinder of FIG. 1 that includes a correct key inserted into the lock cylinder.
Figure 17:
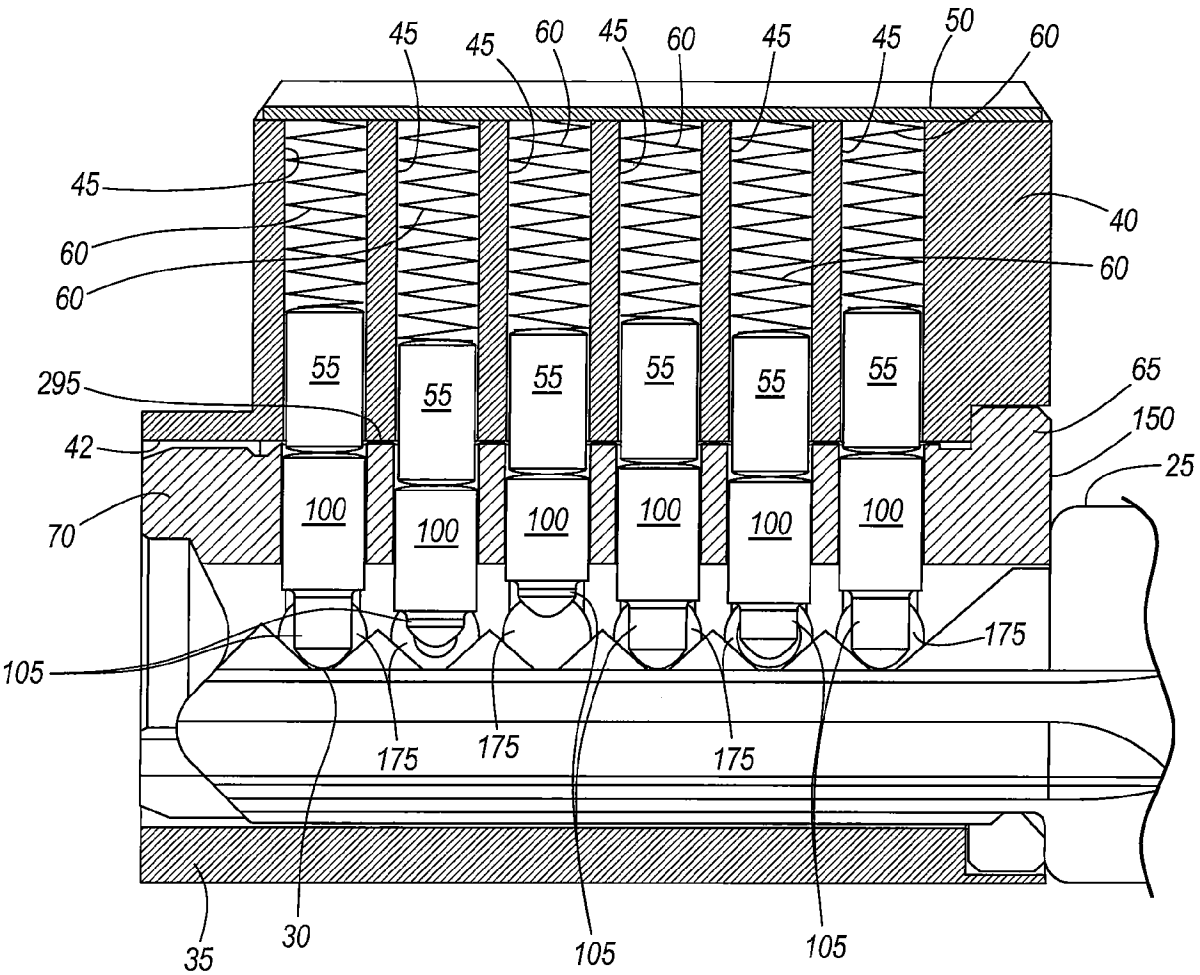
FIG. 17 is a section view of the lock cylinder of FIG. 1 that includes an incorrect key inserted into the lock cylinder.

As shown in FIGS. 1, 16, and 17, the pin portion 40 extends above the wall 35 and includes first or outer pin chambers 45. The outer pin chambers 45 are accessible through a removable member 50 adjacent the outer end of the pin portion 40. In the illustrated construction, the pin portion 40 includes six outer pin chambers 45, but fewer or more outer pin chambers 45 are within the scope of the invention.

Figure 2:
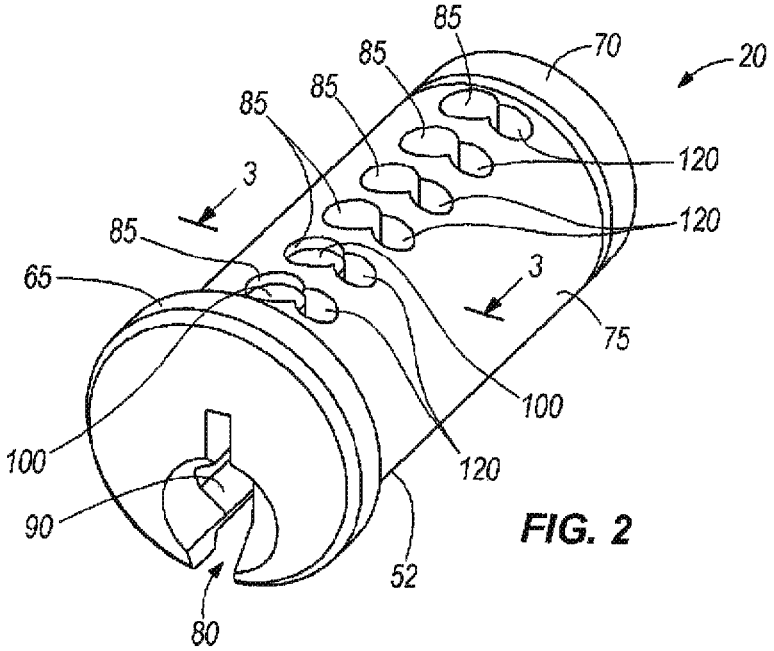
FIG. 2 is a perspective view of a plug for the lock cylinder of FIG. 1.
Figure 3:
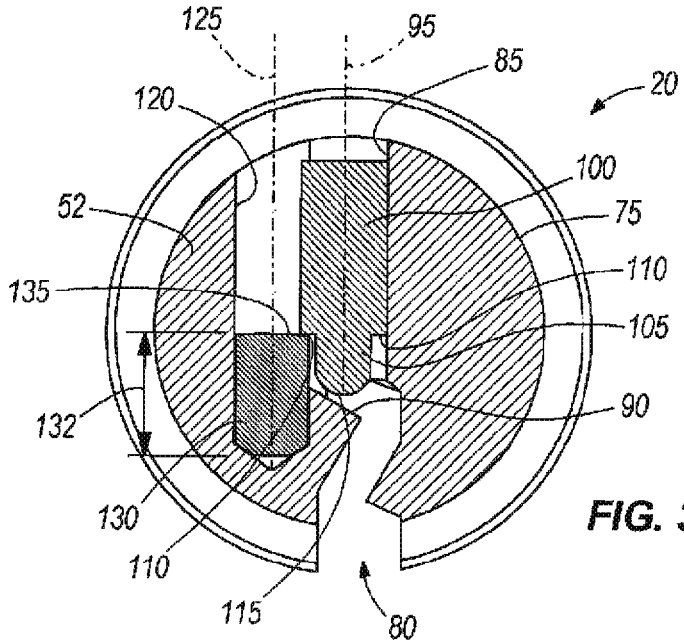
FIG. 3 is a cross-section view of the plug of FIG. 2 taken along line 3-3, and includes an engagement member.

FIGS. 2 and 3 show that the plug 20 includes a body 52 rotatable relative to the hollow portion 42 of the housing 15 (FIG. 1). The body 52 is defined by a first end portion 65, a second portion 70, and an outer surface 75. The first end portion 65 is accessible from the front of the lock cylinder 10. The second end portion 70 is accessible from the rear of the lock cylinder 10.

The plug 20 includes a key slot 80 and second or inner pin chambers 85. The key slot 80 extends longitudinally through the body 52 from the first end portion 65 toward the second end portion 70, and is further accessible from adjacent the first end portion 65. The key slot 80 is defined in part by a pin resting surface 90 that extends a substantial length of the key slot 80.

FIGS. 3 and 16 show that the inner pin chambers 85 extend from the outer surface 75 of the body 52 toward the key slot 80 substantially transverse to the key slot 80. Each of the inner pin chambers 85 defines a first axis 95. The inner pin chambers 85 are in communication with the key slot 80, and are further selectively aligned with respective outer pin chambers 45 upon insertion of the plug 20 into the housing 15. Thus, FIG. 2 shows that the plug 20 includes six inner pin chambers 85. While the inner and outer pin chambers are shown as substantially cylindrical chambers, they can have other shapes (e.g., rectangular, etc.) that are within the scope of the invention.

FIGS. 16 and 17 show that the pin portion 40 further includes a respective first or outer pin 55 disposed within each of the outer pin chambers 45. The outer pins 55 are configured to move in a first or inward direction (downward in FIG. 16) into the plug 20, and in a second or outward direction (upward in FIG. 16) away from the plug 20. The outer pins 55 extend partially into the respective inner chambers 85, as shown in FIG. 17, when the plug is in the locked position and a proper key is not inserted into the slot 80. The pin portion 40 further includes springs 60 to bias the outer pins 55 inward. In other embodiments, the outer pins 55 may tend to move inward without the springs 60. In some embodiments, the outer pins 55 can move inward without engagement by springs 60 due to orientation of the pin portion 40 above the plug 20 (i.e., inward movement is assisted by gravity).

FIGS. 16 and 17 show that a respective second or inner pin 100 is disposed within each of the inner pin chambers 85. Each inner pin 100 can have a length that is the same as or different from the length of the other inner pins 100. Each of the inner pins 100 is selectively engaged with the respective outer pin 55, and includes an end portion 105 that extends into the key slot 80. Generally, the quantity of inner pins 100 will be the same as the quantity of outer pins 55. The end portion 105 is defined by a protrusion that is configured to engage the pin resting surface 90 in the absence of the key 25 in the key slot 80. As shown in FIG. 3, the end portion 105 includes a diameter that is smaller than the diameter of the remaining portion of the inner pin 110. The illustrated end portion 105 is defined by a cylindrical protrusion with a semispherical end. In other embodiments, the end portion 105 may be defined by a protrusion that has other shapes (e.g., tapered cone). The end portion 105 of each inner pin 100 has a length that can be the same as or different from the length of the remaining end portions 105 of the remaining inner pins 100.

In the illustrated construction, the pin portion 40 includes six outer pins 55 and six inner pins 100. However more or fewer outer pins 55 and inner pins 100 may be possible and are within the scope of the invention. For example, commercial applications of the plug 20 usually include six outer and inner pins 55, 100, respectively, in accordance with established industry practices. However, residential applications of the plug 20 usually have settled on five outer and inner pins 55, 100, respectively. In these residential applications, the plug 20 may include five outer pins 55 and inner pins 100 in five corresponding outer and inner pin chambers 45, 85, even though the plug 20 may have six or more outer and inner pin chambers 45, 85. The remaining outer and inner pin chambers 45, 85 may be unused in residential applications. The invention described herein incorporates both commercial and residential applications of the lock cylinder 10, and should not be limited to only one such application.

Figure 6:
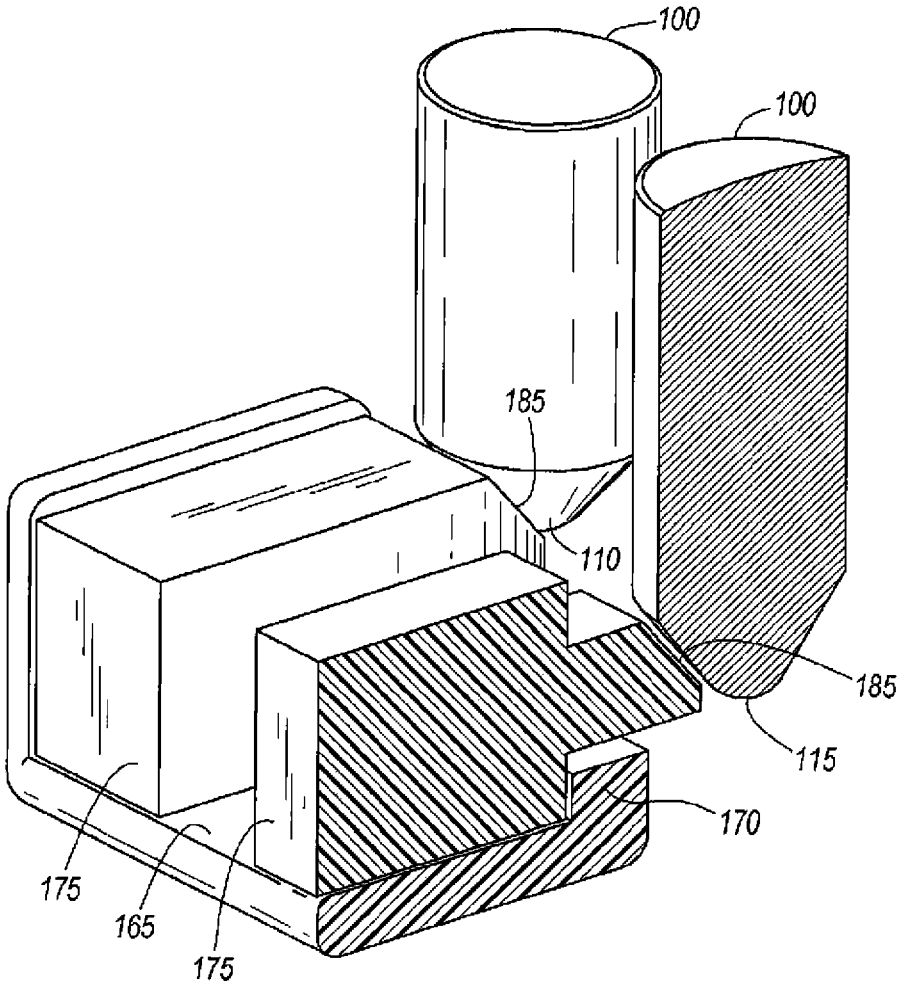
FIG. 6 is a perspective view of alternative pins and engagement members.

The end portion 105 includes a shoulder 110 and a key engagement portion 115. The shoulder 110 at least partially extends around the perimeter of the end portion 105. The shoulder 110 illustrated in FIG. 3 defines a planar surface formed, for example, by a turning process applied to the inner pins 100. In some embodiments, the shoulder 110 may be a curved surface that extends around the entire perimeter of the end portion 105 (FIG. 6). In other embodiments, the shoulder 110 may be defined on one side or more sides of the pin 100 (FIG. 7C). On the pin 100 shown in FIG. 7C, the shoulder 110 extends around only a portion of the perimeter of the end portion 105.

The key engagement portion 115 partially extends into the key slot 80 and is configured to be selectively engaged by the key 25 after insertion of the key 25 into the key slot 80. In some embodiments, the key engagement portion 115 may also engage the pin resting surface 90 in the absence of the key 25 in the key slot 80. In other embodiments, portions of the end portion 105 other than the key engagement portion 115 may engage the pin resting surface 90 in the absence of the key 25 in the key slot 80.

In the embodiment of the invention illustrated in FIGS. 2 and 3, the plug 20 further includes openings or bores or passageways 120 extending substantially into the body 52 without passing entirely through the body 52. Each of the passageways 120 defines a second axis 125 that is substantially parallel to and offset from the first axis 95. Each passageway 120 is in communication with one of the inner pin chambers 85 such that a portion of each passageway 120 overlaps a portion of each inner pin chamber 85. The passageway 120 shown in FIG. 3 is a vertical passageway. Each passageway 120 is preferably a blind bore and is not in direct communication with the key slot 80. The illustrated plug 20 includes six passageways 120 (e.g., one passageway 120 for each of the inner pin chambers 85). In some constructions (e.g., for residential applications), the plug 20 may include five or fewer passageways 120. In other constructions, the plug 20 may include more than six passageways 120. While the illustrated openings are cylindrical, they can have other shapes.

In the embodiment of the invention illustrated in FIG. 3, an engagement member 130 defined by a length 132 is disposed in one of the passageways 120 to engage with the inner pin 100. The engagement member 130 is a separate piece that can be inserted and removed from the passageway 120. In the illustrated construction, the engagement member 130 rests against the blind end of the passageway 120 and includes an outer end or engagement portion 135 that engages the shoulder 110 of the inner pin 100 to limit inward movement of the inner pin 100. Other engagement members 130 can be positioned in one or more of the other passageways 120 to engage the respective inner pins 100.

Figure 4:
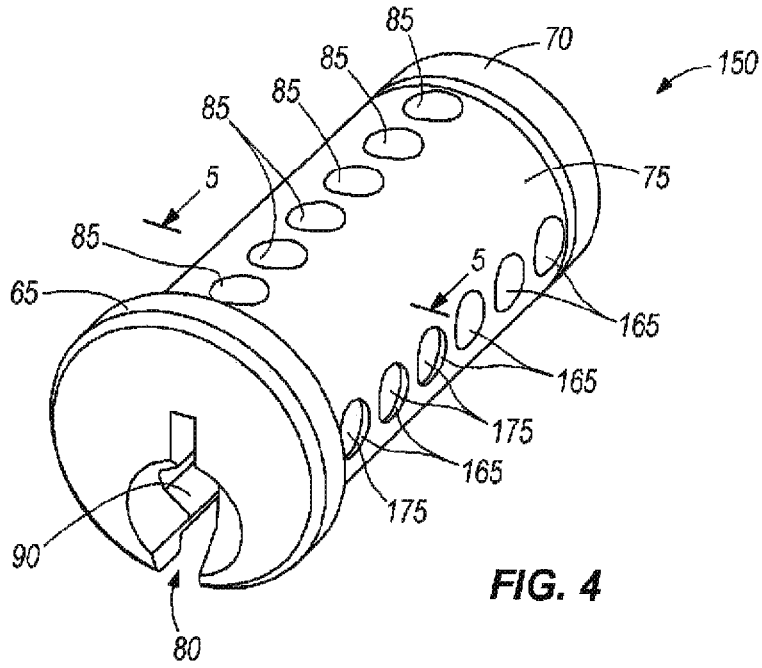
FIG. 4 is a perspective view of another embodiment of a plug for the lock cylinder of FIG. 1.
Figure 5:
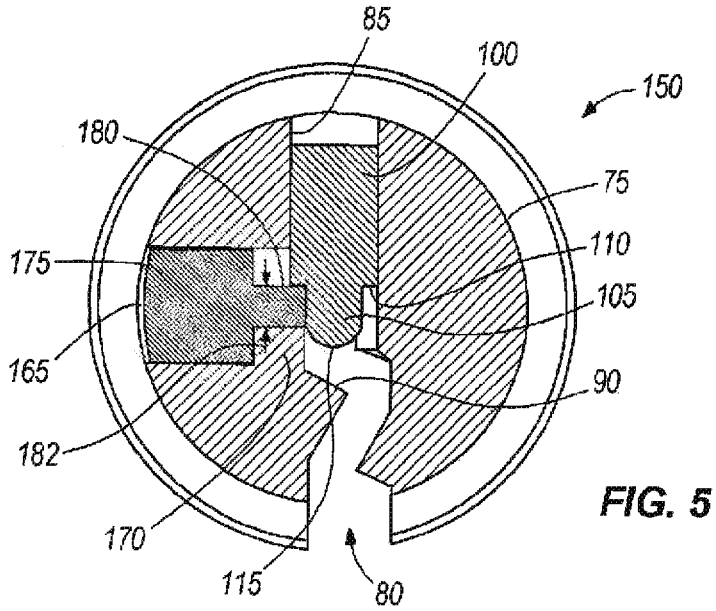
FIG. 5 is a cross-section view of the plug of FIG. 4 taken along line 5-5, and includes an engagement member.

FIGS. 4 and 5 show another embodiment of the invention that has a plug 150 for use with the lock cylinder 10. Except as described below, the plug 150 is the same as the plug 20, and common elements are given the same reference numerals. The plug 150 includes bores or passageways 165 that extend into the plug 150 substantially transverse to the inner pin chambers 85, and further extend into the plug 150 substantially transverse to the key slot 80 from a side of the plug 150. As shown in FIG. 5, the passageway 165 extends horizontally into the plug 150. A stop member or protrusion 170 may be disposed adjacent an inner end of each of the passageways 165. In some constructions, the stop member 170 may be formed by a machining or milling process. In other constructions, the stop member 170 may be formed by a casting process.

FIG. 5 shows an alternative engagement member 175 that is disposed in one of the passageways 165. FIG. 4 shows three engagement members 175 disposed in respective passageways 165. Other constructions of the plug 150 may include fewer or more than three engagement members 175. The engagement member 175 is a separate piece that can be inserted and removed from the passageway 165.

FIG. 5 shows the engagement member 175 positioned within one of the passageways 165 such that inward movement of the engagement member 175 toward the inner pin chamber 85 is limited by the stop member 170. The engagement member 175 is further positioned within one of the passageways 165 such that outward movement of the engagement member 175 is inhibited by the wall 35 of the housing 15. In other words, the engagement member 175 is substantially immovable inward due to engagement of the engagement member 175 with the stop member 170, and is further substantially immovable outward after rotatable engagement of the plug 150 with the housing 15.

The engagement member 175 includes an engagement portion 180 disposed adjacent the inner end of the engagement member 175. The engagement portion 180 may be a protrusion that has a diameter or thickness 182. The engagement member 175 is engaged with one of the inner pins 100 such that the respective engagement portion 180 engages the shoulder 110 of the engaged inner pin 100. In some embodiments, the engagement member 175 may include an angular engagement portion 185 (FIG. 6) that is engaged with the curved shoulder 110 of one of the inner pins 100. FIG. 6 illustrates two possible constructions of the engagement member 175, with each construction defining a rectangular engagement member 175 that includes the angular engagement portion 185.

Figure 7A:
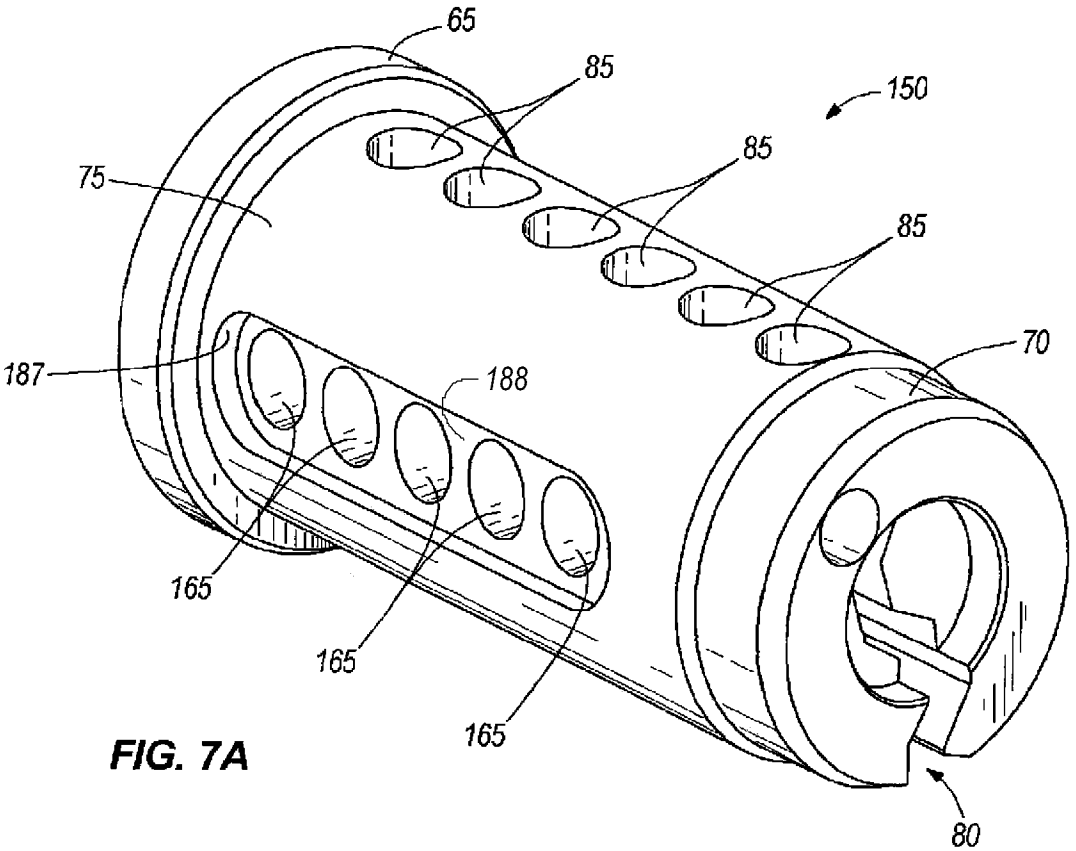
FIG. 7A is a perspective view of an alternative of the plug of FIG. 4.
Figure 7C:
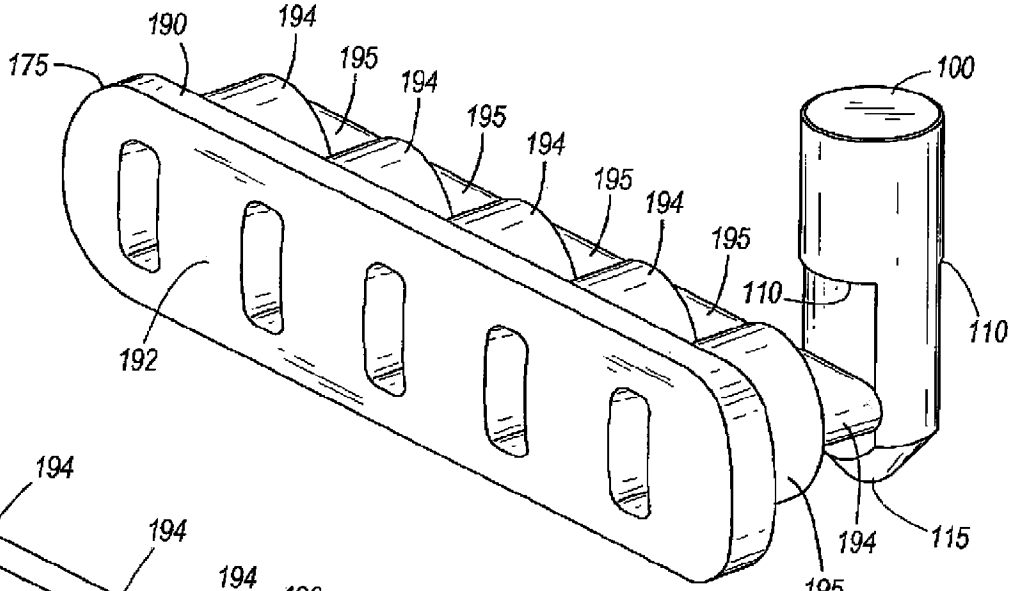
FIG. 7C is another perspective view of the alternative engagement member for the plug of FIG. 7A.
Figure 7B:
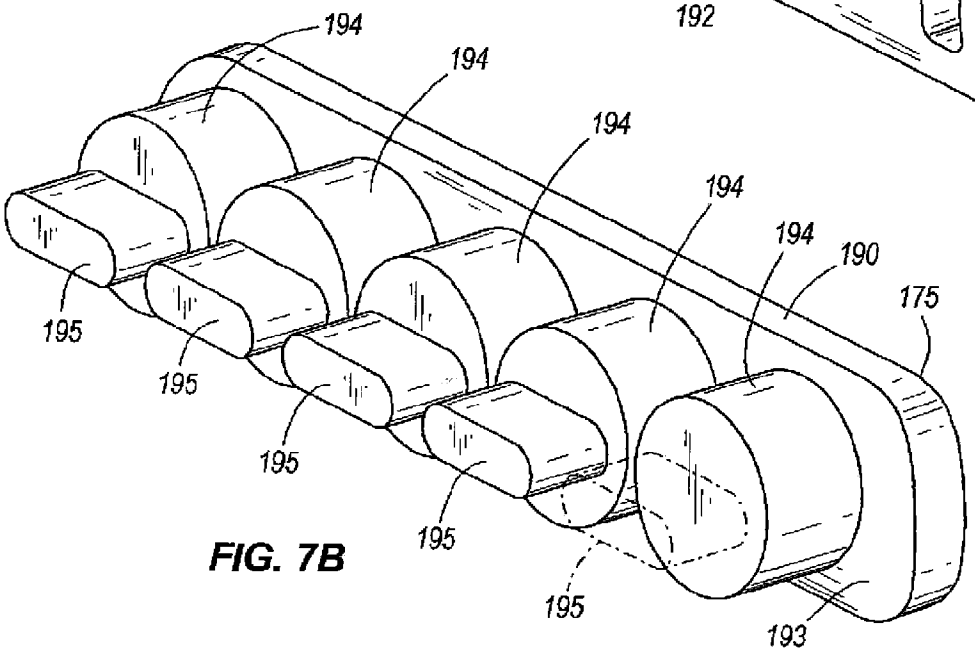
FIG. 7B is a perspective view of an alternative engagement member for the plug of FIG. 7A.

Another embodiment of the invention is illustrated in FIG. 7A-7C. In this embodiment, as shown in FIG. 7A, the plug 150 includes passageways 165 extending inward from a recessed portion 187 that is partially defined by a recessed surface 188 spaced inwardly from the outer surface 75. The passageways 165 extend inward approximately through the middle of the plug 150 along a horizontal diameter of a circular cross-section of the plug 150. The illustrated plug 150 includes six inner pin chambers 85 and five passageways 165 (e.g., for residential applications). In some constructions, the plug 150 may include six or more passageways 165 (e.g., one passageway 165 for each of the inner pin chambers 85, such as used in commercial applications). In other constructions, the plug 150 may include fewer than five passageways 165.

FIGS. 7B and 7C show the engagement member 175 has a unitary body that is configured to insert into the passageways 165 to engage with one or more inner pins 100. Each inner pin 100 (one shown) includes shoulders 110 disposed on both sides of the inner pin 100. The engagement member 175 includes a lip 190, an outer surface 192, an inner surface 193, cylindrical portions 194, and engagement portions 195. Upon insertion of the engagement member 175 into the plug 150, the lip 190 is engaged with the recessed portion 187, and the cylindrical portions 194 extend into respective passageways 165. As shown in FIG. 7C, the outer surface 192 defines a curvature that corresponds to the curvature of the outer surface 75. When the engagement member 175 is positioned within the recessed portion 187, the inner surface 193 (FIG. 7B) is engaged with the recessed surface 188, and the outer surface 192 forms a portion of the outer surface 75 of the plug 150. In other words, in the illustrated construction, the outer surface 192 defines a portion of the same cylinder defined by the outer surface 75. The alignment of the outer surface 75 of the plug 150 with the outer surface 192 of the engagement member 175 permits unimpeded rotation of the plug 150 within the housing 15.

With regard to FIGS. 7B and 7C, the engagement member 175 includes one cylindrical portion 194 for each engagement portion 195. Each engagement portion 195 is engaged with the shoulder 110 of the corresponding inner pin 100, if an inner pin 100 is located in the respective inner pin chamber 85. As shown in FIG. 7B, the engagement member 175 may include separable engagement portions 195 such that one or more engagement portions 195 can be separated from the unitary body without separation of other engagement portions 195.

The illustrated engagement member 175 in FIGS. 7B and 7C includes five cylindrical portions 194 and five engagement portions 195, corresponding to the five passageways 165 disposed in the plug 150 (FIG. 7A). In some embodiments, the engagement member 175 may include more or fewer than five cylindrical portions 194 and five engagement portions 195, the quantity of cylindrical portions 194 and engagement portions 195 corresponding to the quantity of engageable inner pins 100. In other embodiments, the engagement member 175 may be provided with fewer engagement portions 195 than available inner pins 100 (e.g., four engagement portions 195 for a plug that includes five inner pins 100). As discussed below, the inner pins 100 not engaged by engagement portions 195 can be master key pins that allow more than one key with different arrangements of the pin engaging portions 30 to lock and unlock the lock cylinder 10.

In some constructions, the engagement member 175 may be dividable into separate engagement members 175 that each include one or more cylindrical portions 194 and one or more engagement portions 195 configured to insert into one or more of the passageways 165. For example, each engagement member is defined by one cylindrical portion 194 and one engagement portion 195 that can be inserted into a single passageway 165. In these constructions, the separate engagement members 175 are each removable so that one or more of the inner pins 100 may be engaged by the respective engagement portions 195 without affecting the engagement of the other inner pins 100. Dummy pins (not shown) may be inserted into any passageways 165 that do not include engagement members 175 with engagement portions 195 to limit accumulation of debris within the used passageways 165. The dividable engagement member 175 also allows one or more of the inner pins 100 to be defined as master key pins without affecting the engagement of other inner pins 100.

Figure 8:
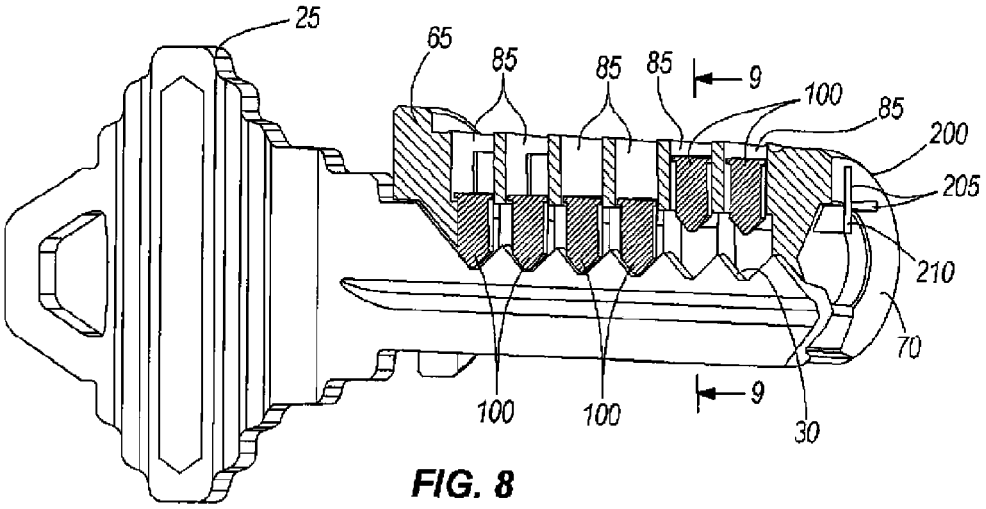
FIG. 8 is a perspective sectional view of another plug for the lock cylinder of FIG. 1.
Figure 9:
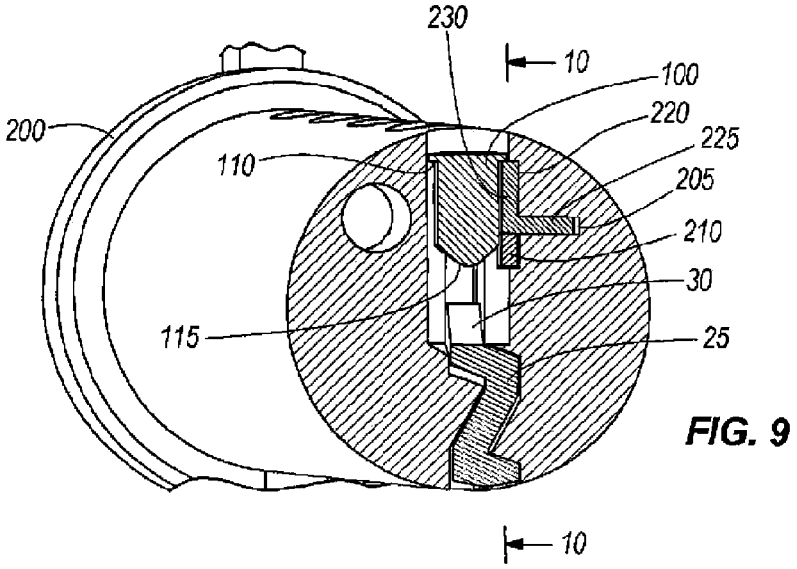
FIG. 9 is a perspective sectional view of a portion of the plug of FIG. 8 taken along line 9-9 that includes an engagement member.

FIGS. 8-10 show another embodiment of the invention that has a plug 200 for use with the lock cylinder 10. Except as described below, the plug 200 is the same as the plug 20, and common elements are given the same reference numerals. The plug 200 includes an opening or aperture or passageway 205 that is disposed substantially parallel to the key slot 80 and transverse to the inner pin chambers 85. The passageway 205 is accessible from the second end portion 70, and extends from the second end portion 70 toward the first end portion 65 and is in communication with each of the inner pin chambers 85.

FIGS. 8 and 9 show the passageway 205 is T-shaped in cross-section and has a vertical leg and a horizontal leg. The passageway 205 receives an engagement member 210. The engagement member 210 slides into the passageway 205 and is in communication with the inner pin chambers 85.

Figure 10A:
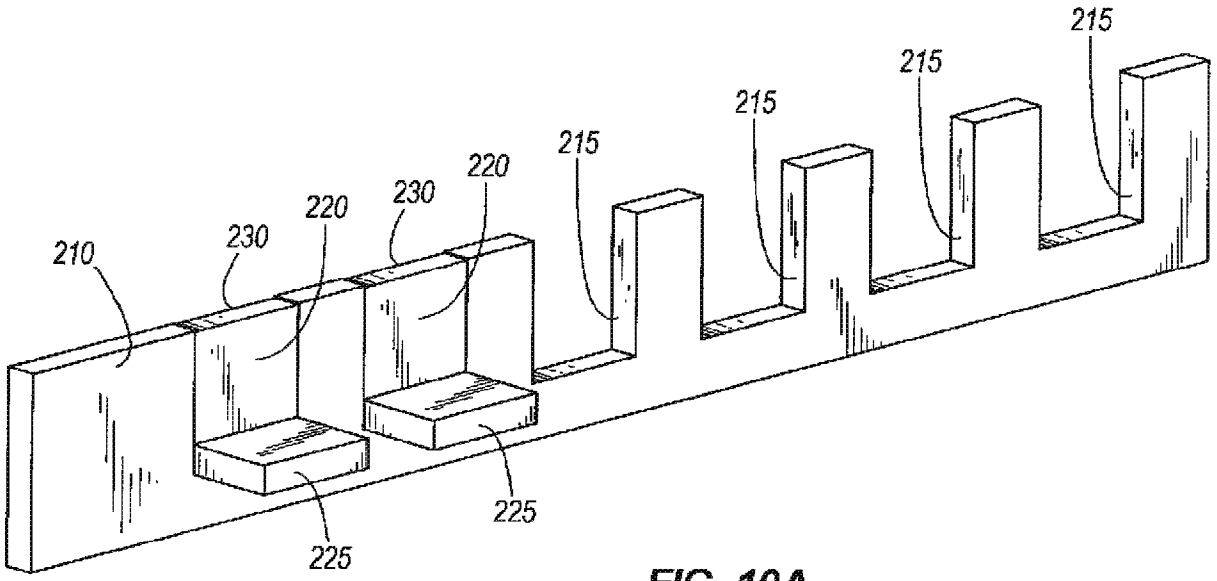
FIG. 10A is a perspective view of the engagement member of FIG. 9.
Figure 10B:
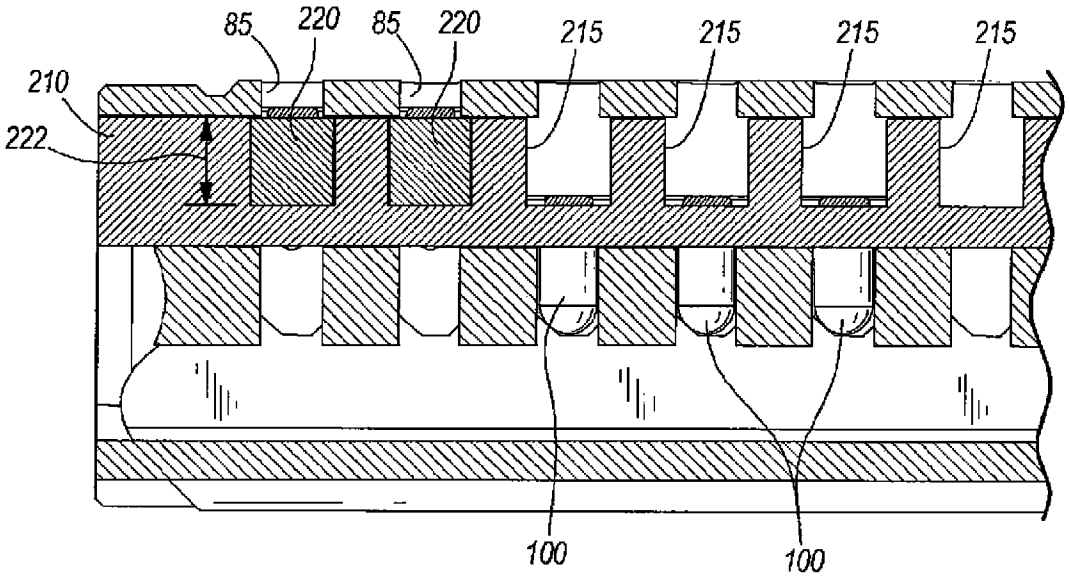
FIG. 10B is a section view of the plug of FIG. 9 taken along line 10-10.

FIGS. 10A and 10B show that the engagement member 210 includes an elongated body forming a rectangular solid, the body having therein notches or recesses 215 extending downward from the upper edge of the body. Each recess 215 is spaced along the engagement member 210 to align with a corresponding inner pin chamber 85 when the engagement member 210 is inserted into the plug 200. The engagement member 210 also includes one or more engagement portions 220 (two shown) seated in respective notches 215. The recesses 215 thus define cradles that partially support the engagement portions 220.

Each engagement portion 220 has an "L"-shaped body that includes a horizontal first portion 225 and a vertical second portion 230. With regard to FIG. 9, the horizontal portion 225 extends into the horizontal leg of the passageway 205. The vertical portion 230 of each engagement portion 220 fills the respective recess 215. The vertical portion is defined by a length 222 that substantially corresponds to the depth of the recess 215. The upper end of the vertical portion 230 is engageable with the shoulder 110 of the respective pin 100. FIG. 10A shows the engagement member 210 with two engagement portions 220. Other constructions of the engagement member 210 may include one or more than two engagement portions 220.

Figure 11:
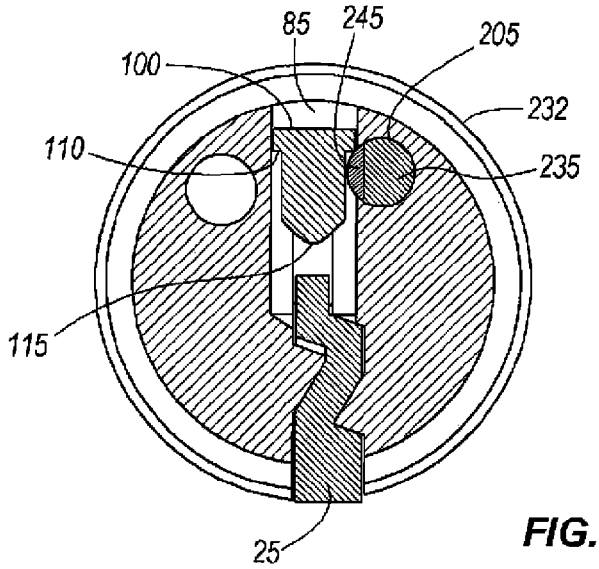
FIG. 11 is a section view of another plug for the lock cylinder of FIG. 1 that includes an engagement member.
Figure 12:
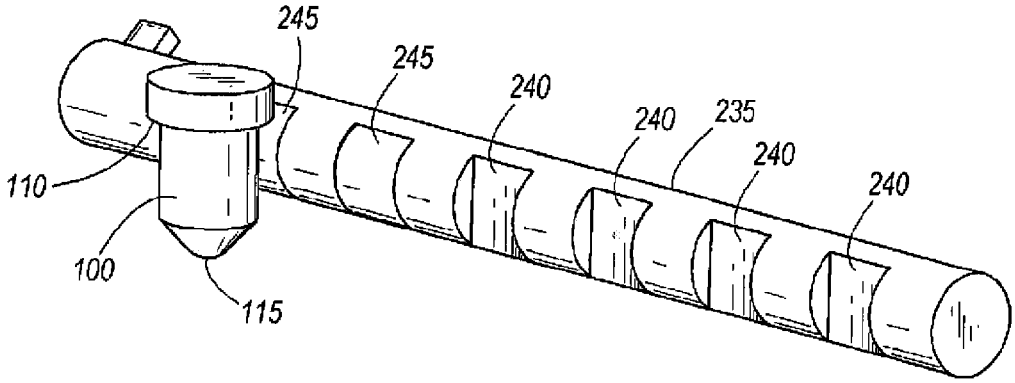
FIG. 12 is a perspective view of the engagement member of FIG. 11.

FIGS. 11 and 12 show another embodiment of the invention that has a plug 232 for use with the lock cylinder 10. In the plug 232, the passageway 205 is a substantially cylindrical hole. An engagement member 235 is disposed in the cylindrical passageway 205. The engagement member 235 is in communication with the inner pin chambers 85 and is defined by a cylindrical body. The engagement member 235 includes recesses 240 and engagement portions 245 (one shown) selectively positioned in the recesses 240. The recesses 240 are spaced along the engagement member 235 to substantially align with respective inner pin chambers 85 when the engagement member 235 is inserted into the plug 200. In FIG. 12, the engagement portion 245 is located in the left-most recess 240.

The engagement portion 245 is a crescent-shaped body that is fixed in one of the recesses 240 to engage with the respective inner pin 100. In some constructions of the engagement member 235, the engagement portion 245 can be removably adhered in the recess 240 using epoxy or other similar adhesive. In other constructions, the engagement portion 245 can be permanently fixed in one of the recesses 240.

Figure 13:
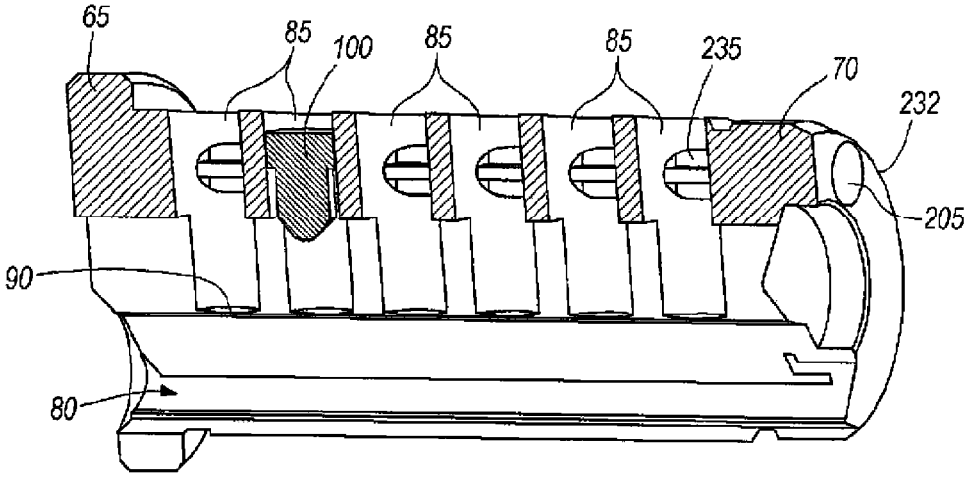
FIG. 13 is a perspective view of another plug for the lock cylinder of FIG. 1 that includes an engagement member.
Figure 14:
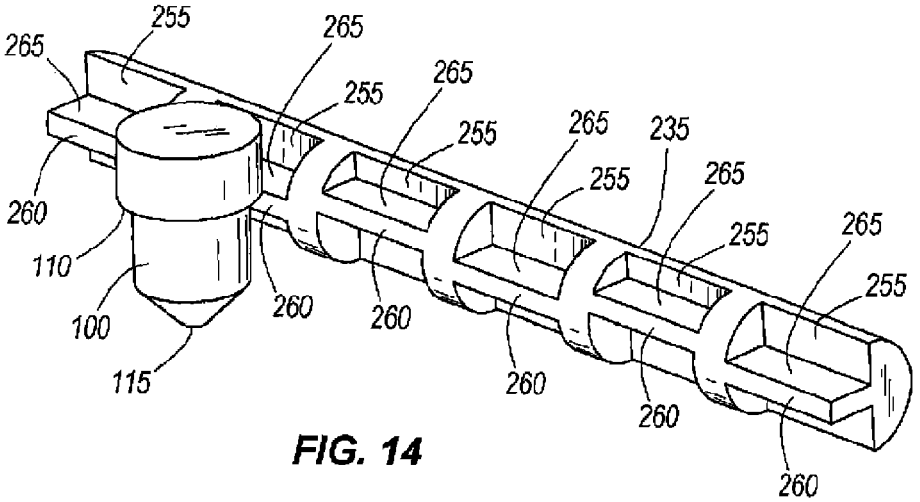
FIG. 14 is a perspective view of the engagement member of FIG. 13.

FIGS. 13 and 14 show an alternative engagement member 235 for use with the plug 232. The engagement member 235 includes recesses 255 and engagement portions 260 positioned in the recesses 255. Like the recesses 240, the recesses 255 are spaced along the engagement member 235 to substantially align with the inner pin chambers 85 when the engagement member 235 is inserted into the plug 200. For purposes of clarity, FIG. 13 only shows one inner pin 100 engaged by one engagement portion 260. Each engagement portion 260 is defined by a protrusion that extends outward from one recess 255, and that includes a planar surface 265 configured to engage with the shoulder 110 of the corresponding inner pin 100. The engagement portions 260 may be configured such that the planar surface 265 of one or more of the engagement portions 260 defines a plane that is different from a plane defined by the other planar surfaces 265. In other words, each surface 265 can be higher or lower than the other surfaces 265. For example, FIG. 14 shows two planar surfaces 265 (i.e., the second and fourth planar surfaces 265 from the right) that are higher than the other planar surfaces 265.

Similar to the engagement portions 245 of FIG. 12, the engagement portions 260 may be removably coupled to the engagement member 235. Preferably, the engagement member 235 and all engagement portions 260 are formed as a unitary body, with the engagement portions 260 being removable from the recesses 255. FIG. 14 shows engagement portions 260 in each of the six recesses 255. Generally, one or more engagement portions 260 may be removed from the recesses 255 such that the engagement portions 260 are positioned in five or fewer recesses 255.

Figure 15:
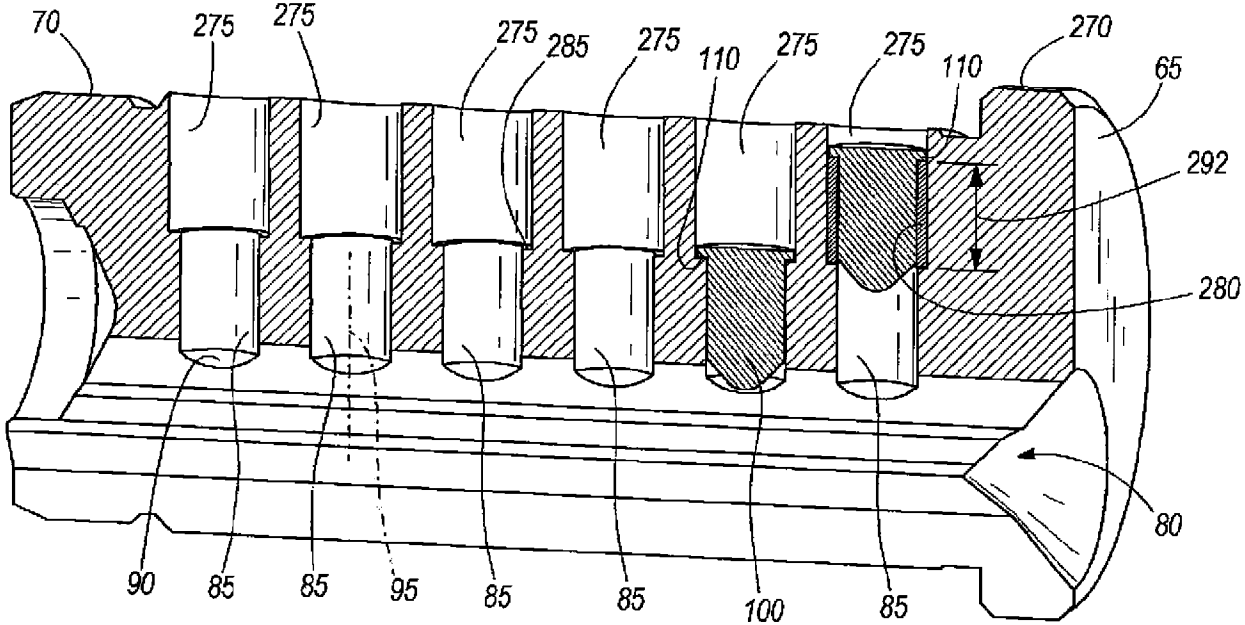
FIG. 15 is a perspective view of another plug for the lock cylinder of FIG. 1 that includes an engagement member.

FIG. 15 shows another embodiment of the invention that has yet another plug 270 for use with the lock cylinder 10. Except as described below, the plug 270 is the same as the plug 20, and common elements are given the same reference numerals. In the plug 270, each of the inner pin chambers 85 has a respective counter bore 275 that defines a surface or shoulder 285. More specifically, the counter bores 275 have a diameter that is larger than the diameter of the inner pin chambers 85 such that the bores 275 are concentric with respect to the inner pin chambers 85. The depth of each counter bore in the plug 270 may be the same or different for each inner pin chamber 85.

The plug 270 includes at least one engagement member 280 (one shown) disposed in a respective bore 275. The engagement member 280 is a hollow cylindrical body that has a length 292. The inner pins 100 are configured to extend partially through the hollow engagement members 280 after insertion of the engagement members 280 into one or more of the bores 275. The upper end of the engagement member 280 is engaged with the shoulder 110 of the inner pin 100, and the lower end of the engagement member 280 is engaged with the shoulder or surface 285 to limit inward movement of the inner pin 100 toward the key slot 80. The engagement members 280 are removably disposed in the passageways 275. In other constructions of the plug 270, the engagement members 280 may be permanently attached in the passageways 275. In other embodiments, the engagement members 280 can be eliminated and the shoulders 110 of the inner pins 100 can directly engage the shoulders 285, which can be higher than shown in FIG. 15 if necessary.

Another embodiment of the invention is illustrated in FIGS. 19-24. This embodiment includes a plug 300 for use with the lock cylinder 10. Except as described below, the plug 300 is similar to the plug 150 described with regard to FIG. 7A, and common elements are given the same reference numerals. The inner pin chambers 85 have a longitudinal axis 312, and the passageways 165 have a central axis 314 that is generally perpendicular to the longitudinal axis 312. In the plug 300, the passageways 165 extend inward from a recessed portion 305 that is partially defined by a substantially planar recessed surface 310. The recessed surface 310 defines a chord of the surface 75 and has therein openings to the passageways 165.

Figure 19:
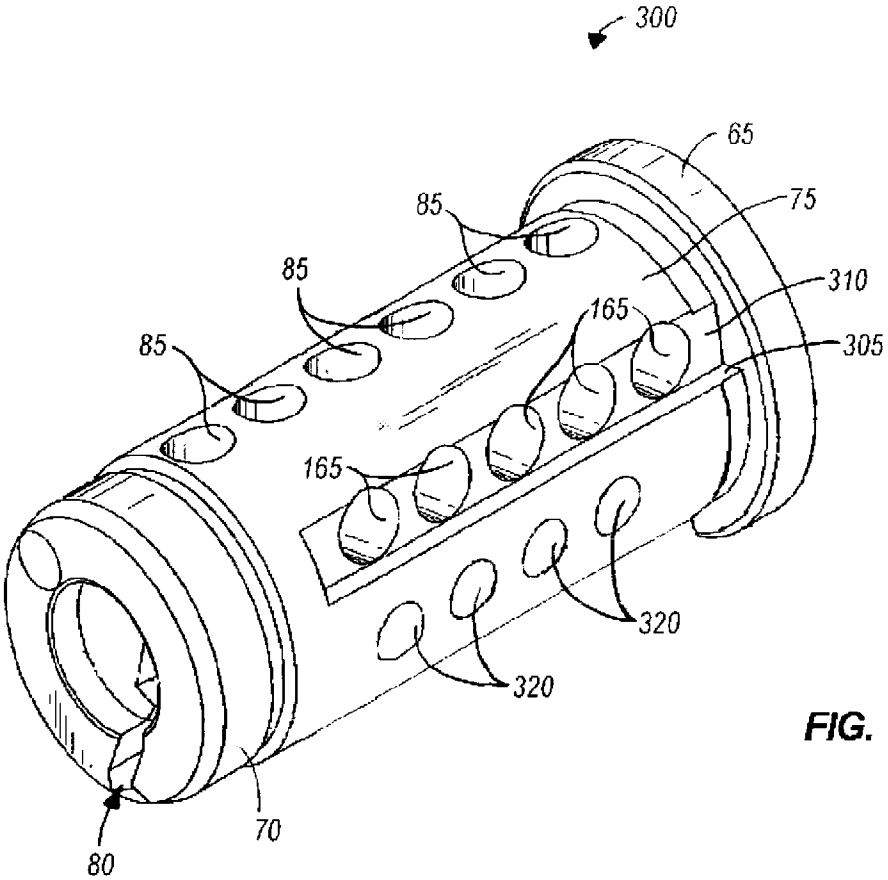
FIG. 19 is a perspective view of an alternative of the plug of FIG. 7A.

Unlike the passageways 165 and the recessed portion 187 illustrated in FIG. 7A, the passageways 165 and the recessed portion 305 shown in FIG. 19 extend inward from the outer surface 75 through the upper portion of the plug (i.e., above a horizontal diameter of a circular cross-section of the plug 300). The illustrated plug 300 includes six inner pin chambers 85 and five passageways 165 (e.g., for residential applications). In other constructions, the plug 300 may include more than or fewer than five passageways 165.

Figure 20:
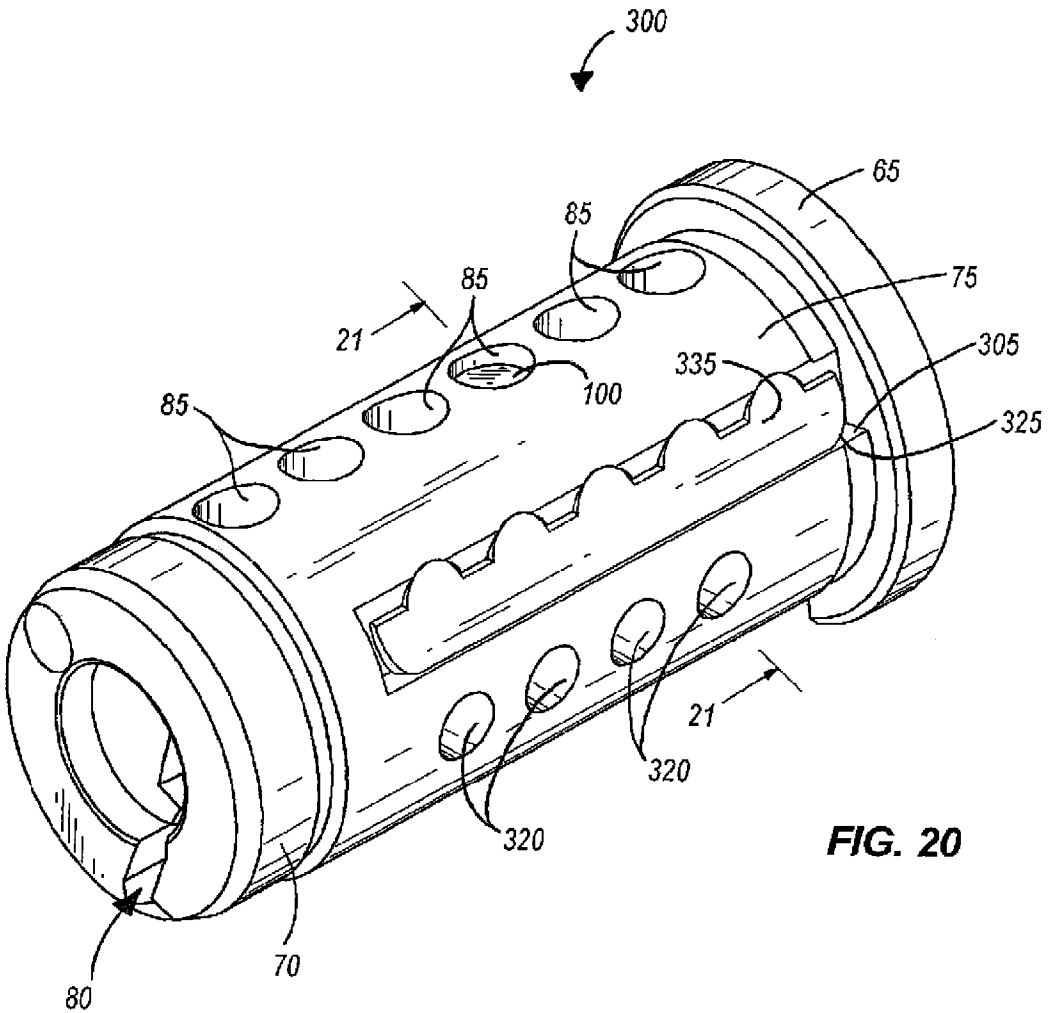
FIG. 20 is a perspective view of the plug of FIG. 19 that includes an alternative engagement member.
Figure 21:
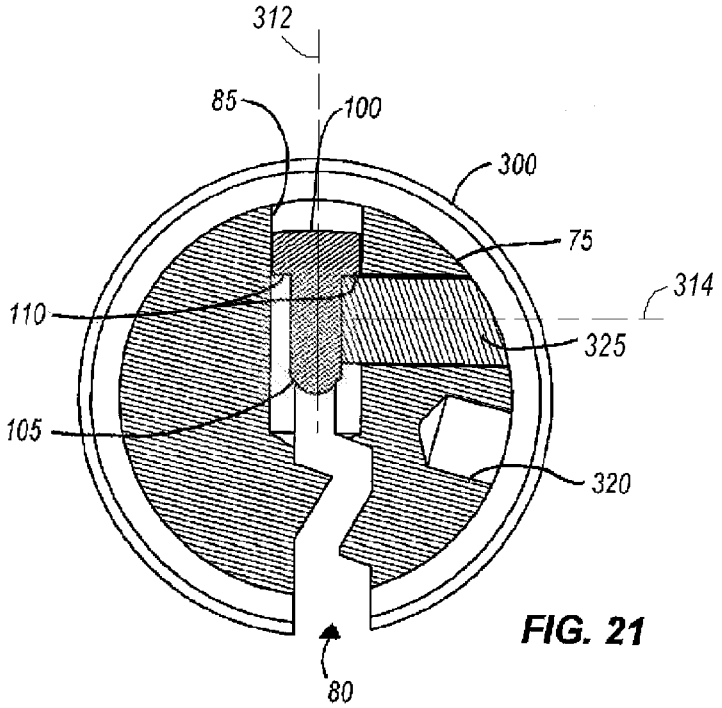
FIG. 21 is section view of the plug of FIG. 20, taken along line 21-21.

FIGS. 19-21 show that the plug 300 includes bores 320 for use with residential applications to allow construction keying of the lock cylinder 10. The bores 320 extend radially, like the inner pin chambers 85, but extend angularly upward toward the key slot 80 from below the horizontal diameter of the plug 300. The bores 320, like the inner pin chambers 85, are aligned along a plane passing through a longitudinal axis of the cylinder defined by the surface 75. The illustrated plug 300 has four bores 320, which are aligned circumferentially with four of the inner pin chamber 85, so that the bores 320 will become aligned with four of the outer pin chambers 45 if the plug 300 is rotated to the correct position.

In some constructions, residential keying devices utilize ball bearings (not shown) in the inner pin chambers 85 to allow one or more construction keys and residential keys (not shown) to lock and unlock the plug 300. The ball bearings are located between the inner and outer pins 55, 100. With a construction key, the shear line is between the ball bearings and the outer pins 55 such that the ball bearings remain in the inner pin chambers 85 when the plug 300 is rotated. With a residential key, the shear line is between the inner pins 100 and the ball bearings, so that the ball bearings are in the outer pin chambers when the plug 300 is rotated. The first time that a residential key is used and the plug 300 is rotated, the ball bearings fall into the bores 320 when the plug 300 has been rotated to the position in which the bores 320 become aligned with the outer pin chambers 45. Thereafter, the ball bearings remain in the bores 320 and only the residential key can be used to lock and unlock the plug 300.

FIGS. 20-24 show an alternative engagement member 325 that has a unitary body insertable into the plug 300 and configured to engage one or more inner pins 100 when the engagement member 325 is engaged with the recessed portion 305. Similar to the engagement member 175 described with regard to FIGS. 7B and 7C, the engagement member 325 includes a lip 330, an outer surface 335, an inner surface 340, cylindrical portions 345, and engagement portions 350. Upon insertion of the engagement member 325 into the plug 300, the lip 330 is disposed in the recessed portion 305, and the cylindrical portions 345 and the engagement portions 350 extend into respective passageways 165. The outer surface 335 defines a curvature that corresponds to the curvature of the outer surface 75 of the plug 300 when the engagement member 325 is inserted into the plug 300. In other words, the outer surface 335 defines the same cylinder as defined by the outer surface 75. The inner surface 340 is substantially planar and is engaged with the recessed surface 310 when the engagement member 325 is positioned within the recessed portion 305. The cylindrical portions 345 are engaged with the passageways 165 and the engagement portions 350 are engaged with respective inner pins 100 when the engagement member 325 is inserted into the plug 300.

Figure 22:
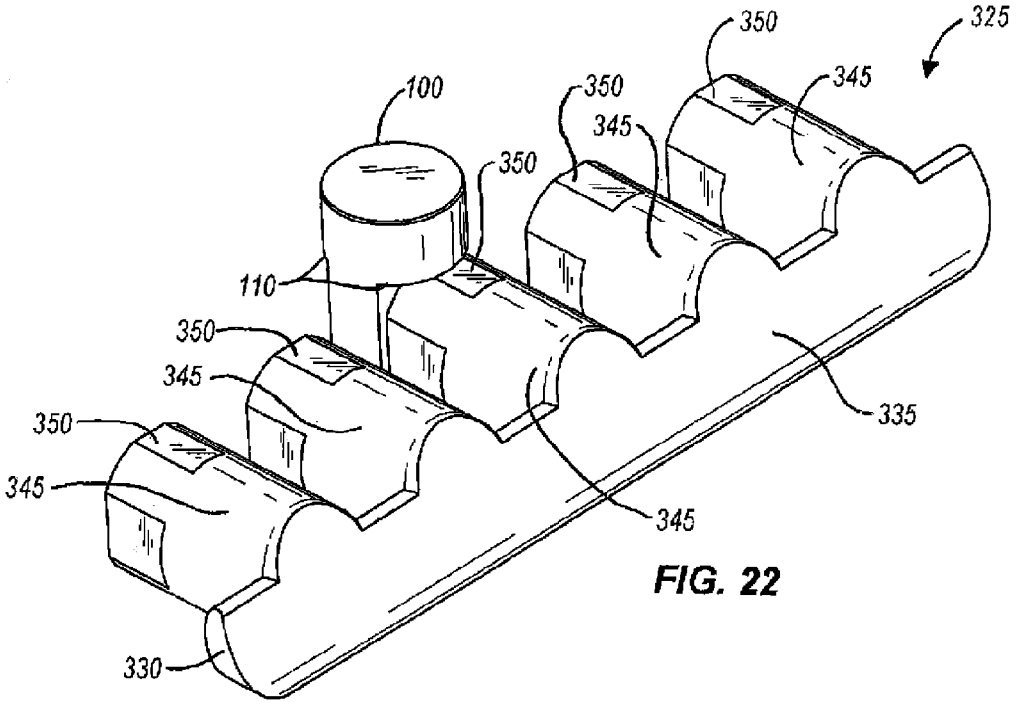
FIG. 22 is a perspective view of the alternative engagement member for the plug of FIG. 19.
Figure 23:
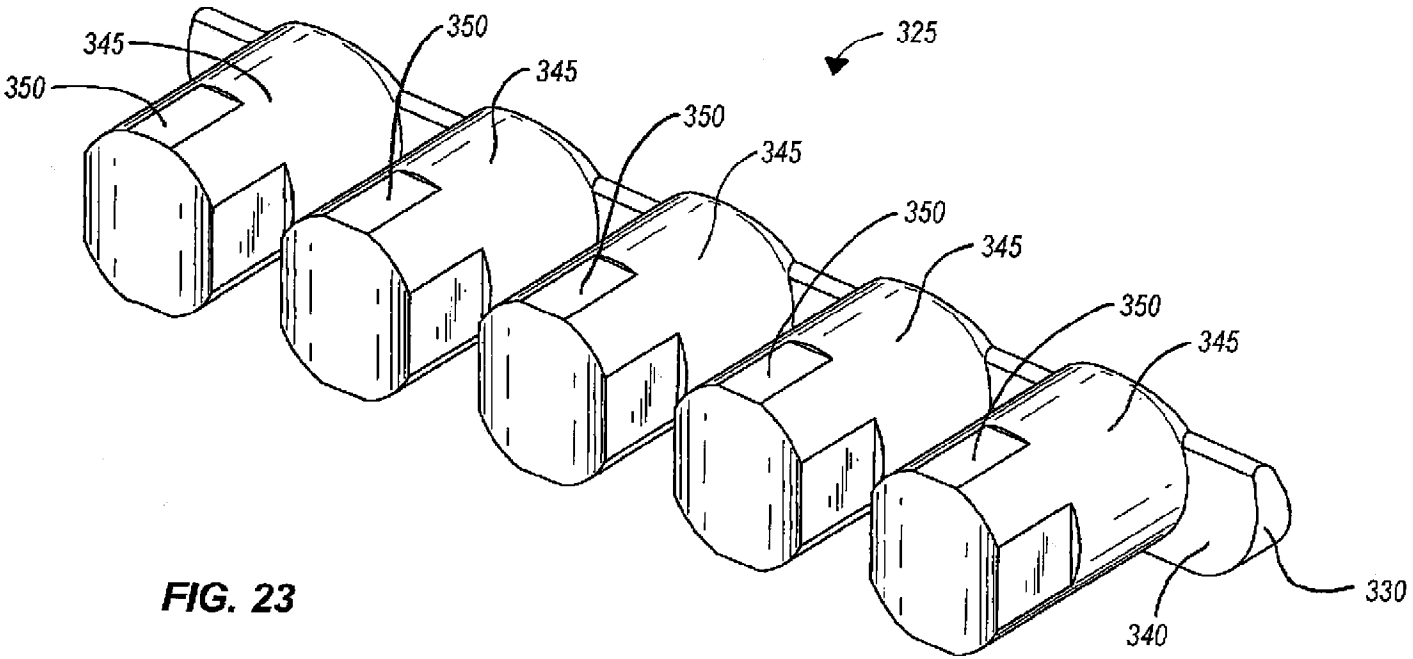
FIG. 23 is another perspective view of the alternative engagement member for the plug of FIG. 19.
Figure 24:
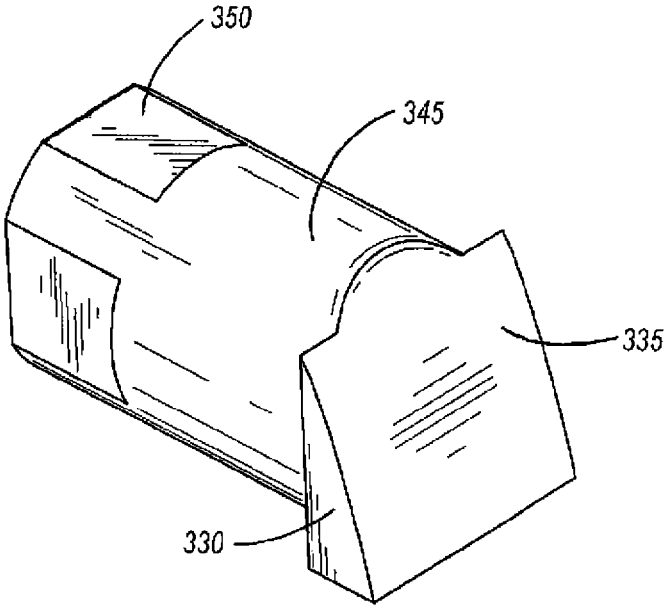
FIG. 24 is a perspective view of an alternative engagement member for the plug of FIG. 19.

As illustrated in FIG. 22, each engagement portion 350 is engaged with the shoulder 110 of the corresponding inner pin 100, if an inner pin 100 is located in the respective inner pin chamber 85. FIG. 24 shows that the engagement member 325 can be separate bodies such that each body includes one cylindrical portion 345 and one engagement portion 350. The engagement member 325 can be split into separate bodies, or formed as separate pieces. Dummy pins (not shown) can be inserted into any passageways 165 that do not include the separated engagement members 325 to limit accumulation of debris within the passageways 165. The dividable engagement member 325 also allows one or more of the inner pins 100 to be defined as master key pins without affecting the engagement of other inner pins 100.

FIGS. 16 and 17 show lock cylinder 10 with the key 25 inserted into the key slot 80 of the plug 150. While the lock cylinder 10 discussed with regard to FIGS. 16 and 17 incorporate the plug 150, the scope of the invention considers that any of the plugs 20, 200, 232, 270 may be substituted in place of the plug 150. FIG. 16 shows a correct or proper key 25 inserted into the plug 150 of the lock cylinder 10. The pin engaging portions 30 of the proper key 25 are engaged with each of the inner pins 100 to move the outer pins 55 to a shear line 295 defined by the outer surface 75 of the plug 150 and the wall 35 of the housing 15. Once the outer pins 55 are moved to the shear line 295, the plug 150 can be rotated between locked and unlocked positions.

FIG. 17 shows an incorrect or improper key 25 inserted into the plug 150 of the lock cylinder 10. The pin engaging portions 30 of the key 25 illustrated in FIG. 17 are cut to the deepest cuts possible for the key 25. The springs 60 bias the outer pins 55 and the inner pins 100 inward such that the outer pins 55 partially extend into the inner pin chambers 85. The inner pins 100 are spaced different distances from the pin resting surface 90 due to engagement of at least some of the inner pins 100 by the engagement members 175. As such, some of the pin engaging portions 30 of the improper key 25 are not engaged with the inner pins 100, and the key 25 cannot be used to move the plug 150 between the locked and unlocked positions. For example, FIG. 17 shows one inner pin 100 spaced from the pin resting surface 90 such that no portion of the improper key 25 comes into contact with the end portion 105 when the improper key 25 is inserted into the plug 150. The inner pins 100 spaced different distances from the pin resting surface 90 inhibit "bumping" or moving the outer pins 55 toward the shear line by engaging the inner pins 100 with the improper key 25.

Figure 18:
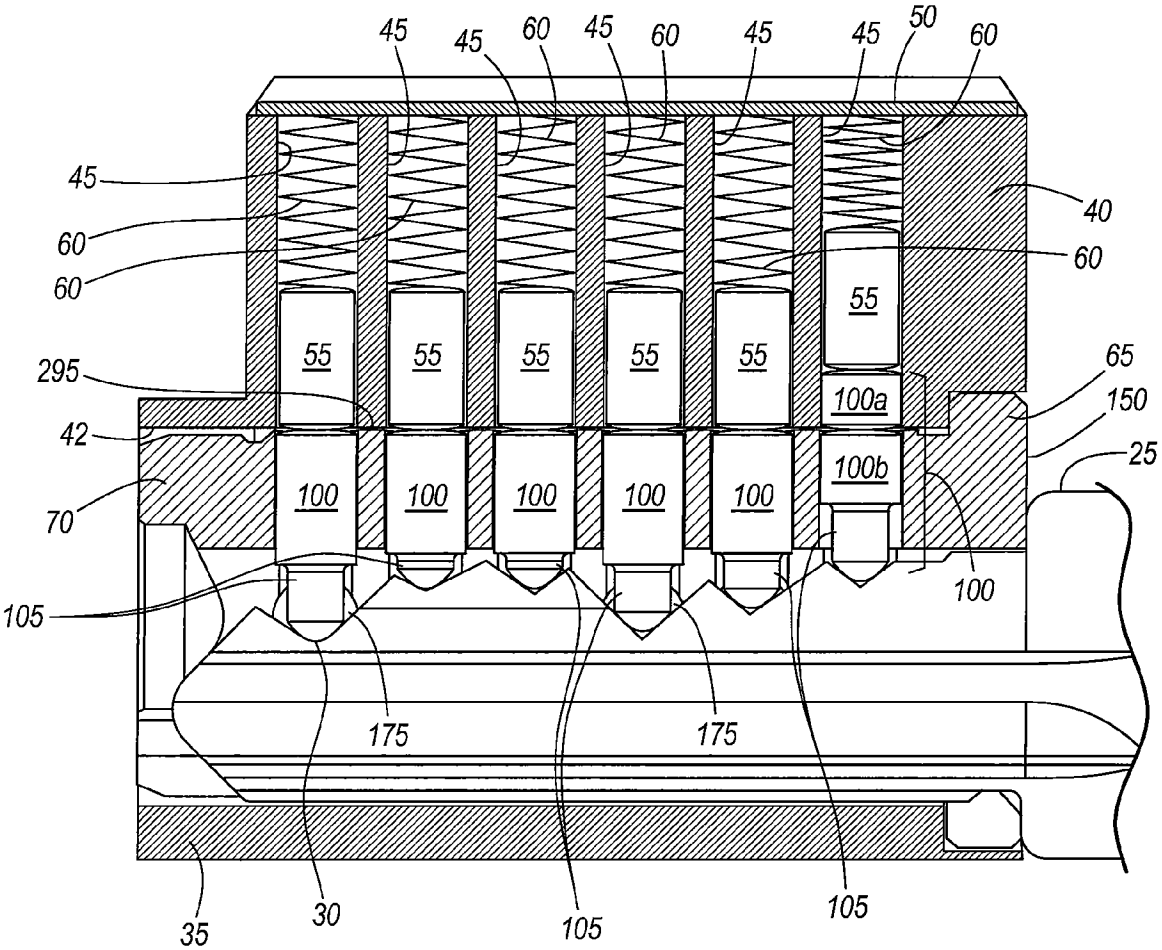
FIG. 18 is a section view of an alternative lock cylinder.

The inner pins 100 not engaged by the engagement members 175 can be master key pins that allow more than one key (i.e., a master key and a non-master key) with different arrangements of the pin engaging portions 30 to lock and unlock the lock cylinder 10. FIG. 18 shows the lock cylinder 10 with the right-most inner pin 100 as a master key pin. The master key pin 100 includes a first pin element 100*a* and a second pin element 100*b* that is separate from the first pin element 100*a*. In some constructions, the master key pin 100 may be divided into three or more pin elements. One of the first and second pin elements 100*a*, 100*b* aligns with the shear line 295 upon insertion of a correct key into the key slot 80.

FIG. 18 shows the key 25 that is a master key (i.e., a correct key) inserted into the key slot 80. In other constructions, the key 25 shown in FIG. 18 may be a non-master key. The master key defines a first arrangement of the outer and inner pins 55, 100 that unlocks the plug 150. The non-master key defines a second arrangement of the outer and inner pins 55, 100 that is different from the first arrangement, and that also unlocks the plug 150. As shown in FIG. 18, the first arrangement is defined by the outer pins 55 and the first pin element 100*a* completely outside the plug 150, and the remaining inner pins 100 and the second pin element 100*b* completely inside the plug 150. In other words, the space between the first pin element 100*a* and the second pin element 100*b* partially aligns with the shear line 295 upon insertion of the master key 25 into the key slot 80.

The second arrangement (not shown) is defined by the outer pins 55 completely outside the plug 150, and the inner pins 100, including the first and second pin elements 100*a*, 100*b* completely inside the plug 150. In other words, the space between one of the outer pins 55 and the first pin element 100*a* partially aligns with the shear line 295 upon insertion of a non-master key into the key slot 80. The first and second arrangements allow the plug 150 to be moved between the locked and unlocked positions using more than one correct key 25 with different pin engaging portions 30.

With regard to FIGS. 2 and 3, the engagement members 130 engage some of the inner pins 100 in the plug 20 to space the engaged inner pins 100 a non-zero distance from the pin resting surface 90 in the absence of the key 25 in the key slot 80. The engagement members 130 are not directly engaged by the key 25 when the key 25 is inserted into the key slot 80 (FIGS. 16-18). The inner pins 100 not engaged by the engagement members 130 are engaged with the pin resting surface 90. As such, the engaged inner pins 100 and the non-engaged inner pins 100 define a lock arrangement of the plug 20 that is dependent on which inner pins 100 are engaged by the engagement members 130.

The lengths 132 of one or more of the engagement members 130 can be the same or different as the remaining engagement members 130, and affects the distance that the engaged inner pins 100 are spaced from the pin resting surface 90. Relatively long engagement members 130 space the respective inner pins 100 a relatively large distance, while relatively short engagement members 130 space the respective inner pins 100 a relatively small distance. In other words, the distance that one of the engaged inner pins 100 is spaced from the pin resting surface 90 can be the same or different from the distance that another of the engaged inner pins 100 is spaced from the pin resting surface 90. When the inner pins 100 are engaged by the engagement members 130, the key engagement portions 115 of the engaged inner pins 100 do not engage the pin resting surface 90.

Due to the presence of one or more engagement members 130, the inner pins 100 of the plug 20 extend different distances into the key slot 80 in the absence of the key 25 in the key slot 80. More specifically, the inner pins 100 that are engaged by the engagement members 130 extend into the key slot 80 respective first distances without engagement with the pin resting surface 90. The inner pins 100 that are not engaged by the engagement members 130 extend into the key slot 80 a second distance and engage the pin resting surface 90. The respective first distances that the engaged inner pins 100 extend into the key slot 80 depends on the length 132 of the respective engagement members 130, and also depends on the length of the end portions 105. As such, the respective first distance that each of the inner pins 100 extends into the key slot 80 can be the same or different for each inner pin 100. The second distance that the inner pins 100 extend into the key slot 80 is the same distance (i.e., the distance from the opening in the key slot 80 to the pin resting surface 90) for each non-engaged inner pin 100. In general, the engagement members 130 are pins that can be inserted and removed from the passageways 120 to change the spacing of one or more of the inner pins 100 from the pin resting surface 90, and to change the distance that the inner pins 100 extend into the key slot 80.

Except as described below, operation and modification of the plugs 150, 200, 232, 270 and the engagement members 175, 210, 235, 280 are similar to the operation and modification of the plug 20 and the engagement members 130 described with regard to FIGS. 2 and 3. Generally, the engagement members 130 are insertable into the plug 20 and provided in a particular arrangement or selected set to engage corresponding inner pins 100. The selected set of engagement members 130 is defined by the desired locking characteristics of the lock cylinder 10. For example, if only one inner pin 100 is desired to be spaced from the pin resting surface 90 (e.g., the other inner pins 100 are master key pins), then only one engagement member 130 is provided to space the respective inner pin 100 a distance from the pin resting surface 90. If additional inner pins 100 are desired to be spaced a distance from the pin resting surface 90, additional corresponding engagement members 130 can be inserted into the plug 20.

The inner pins 100 are inserted into the plug 20 after the engagement member 130 is inserted into the plug 20. Engagement of the inner pins 100 with the selected engagement members 130 space the inner pins 100 a distance from the pin resting surface 90 according to the desired arrangement. The inner pins 100 are inserted into the plug through the pin portion 40 in the housing 15. The outer pins 55 are inserted into the housing 15 through the pin portion 40 after insertion of the inner pins 100. The outer pins 55 generally contact the inner pins 100 and can be biased toward the inner pins 100 using the springs 60.

The particular set of engagement members 130 can be varied depending on the desired locking characteristics of the lock cylinder 10. Modification of the selected set of engagement members 130 provided in the plug 20 may re-key the plug from a first lock arrangement to a second lock arrangement. More specifically, modification of the engagement members 130 may change the inner pins 100 that are defined as master key pins. As such, a new master key and/or a new non-master key that is different from the original master key and/or non-master key can be used to unlock the lock cylinder 10.

Modification of the engagement member 130 can include repositioning the engagement member 130 in the plug 20, removing the engagement member 130 from the plug 20, adding an additional engagement member 130 to the plug 20, replacing the engagement member 130 in the plug 20 with a different engagement member 130, and a combination of two or more of these processes (e.g., removal and addition of one or more engagement members 130).

Repositioning an engagement member 130 includes moving the engagement member 130 from a first passageway 120 in the plug 20 to a second passageway 120 (i.e., the engagement member 130 is removed from the first passageway 120 and inserted into the second passageway 120). As a result, the originally engaged inner pin 100 in communication with the first passageway 120 is no longer engaged by the engagement member 130. Instead, the originally engaged inner pin 100 is engaged with the pin resting surface 90. The inner pin 100 in communication with the second passageway 120 is engaged by the repositioned engagement member 130, and is no longer engaged with the pin resting surface 90.

Modification facilitated by removal of undesired engagement members 130 from the plug 20 allows the originally engaged inner pins 100 to engage the pin resting surface 90. Addition of one or more desired engagement members 130 to the plug 20 spaces one or more previously non-engaged inner pins 100 a non-zero distance from the pin resting surface 90. Modification of an engagement member 130 by replacement of a first engagement member 130 with a second engagement member 130 that has a different length than the first engagement member 130 also changes the distance that the engaged inner pin 100 is spaced from the pin resting surface 90, and thus the lock arrangement of the plug 20.

As described above, the engagement members 130 originally positioned in the plug 20 define a first lock arrangement that may be altered by modification of one or more engagement members 130. When one or more of the original engagement members 130 are modified, the plug 20 can be defined by a second lock arrangement that may be different from the first lock arrangement. Modification of one or more of the engagement members 130 provides many different arrangements of the inner pins 100 within the plug 20 based on the distance that the inner pins 100 are spaced from the pin resting surface 90 and the distance that the inner pins 100 extend into the key slot 80.

FIGS. 4 and 5 show the engagement members 175 engaged with some of the inner pins 100 of the plug 150 to space the inner pins 100 at least one non-zero distance from the pin resting surface 90. The non-engaged inner pins 100 engage the pin resting surface 90. The distance that the engaged inner pins 100 are spaced from the pin resting surface 90 is dependent on the diameter or thickness 182 of the engagement portions 180, and further is dependent on the length of the end portions 105 of the inner pins 100. The engagement members 175 may have engagement portions 180 that are defined by the same or different diameters 182 that affect the distance that the inner pins 100 are spaced from the pin resting surface 90. Relatively large diameter engagement portions 180 space the respective inner pins 100 a relatively large distance from the pin resting surface 90. Relatively small diameter engagement portions 180 space the respective inner pins 100 a relatively small distance from the pin resting surface 90.

Due to the presence of at least one engagement member 175 in the plug 150, the inner pins 100 of the plug 150 extend different distances into the key slot 80 in the absence of the key 25 in the key slot 80. Similar to the distance that the engaged inner pins 100 are spaced from the pin resting surface 90, the distance that the engaged inner pins 100 extend into the key slot 80 is dependent on the diameter 182 of the respective engagement portions 180 and on the length of the end portions 105. As such, the respective distance that each of the inner pins 100 extends into the key slot 80 may be the same or different as the distance that the remaining pins 100 extend into the key slot 80.

With regard to FIGS. 7A, 7B, and 7C, the illustrated engagement member 175 can be positioned in the recessed portion 187 to engage one or more inner pins 100. As discussed above, the engagement portions 195 are separately removable such that one or more of the inner pins 100 may not be engaged by a respective engagement portion 195. The distance that the engaged inner pins 100 are spaced from the pin resting surface 90 is dependent on the thickness of the engagement portions 187, and further is dependent on the length of the end portions 105 of the inner pins 100. The thickness of each engagement portion 195 may be altered to space the respective inner pin a non-zero distance from the pin resting surface 90 that is different from the non-zero distance other inner pins 100 may be spaced from the pin resting surface 90.

Due to the presence of at least one engagement portion 195, the inner pins 100 of the plug 150 extend different distances into the key slot 80 in the absence of the key 25 in the key slot 80. Similar to the distance that the engaged inner pins 100 are spaced from the pin resting surface 90, the distance that the engaged inner pins 100 extend into the key slot 80 is dependent on the thickness of the respective engagement portions 195 and on the length of the end portions 105. As such, the respective distance that each of the inner pins 100 extends into the key slot 80 may be the same or different as the distance that the other inner pins 100 extend into the key slot 80.

Generally, the engagement members 175 illustrated in FIGS. 4-6 include pins that can be inserted and removed from the passageways 165, and that can be modified similar to the modification described with regard to FIGS. 2 and 3 (e.g., repositioned, removed, added, and any combination thereof). The engagement member 175 discussed with regard to FIG. 7B includes the cylindrical portions 194 that function similarly to the pins defined by the engagement members 175 discussed with regard to FIGS. 4-6, except that the engagement member 175 shown in FIG. 7B includes engagement portions 195 that can be modified (e.g., repositioned, removed, added) in addition to modification of the engagement member 175. As such, any combination of repositioning, removal, and addition of the engagement members 175 is possible and within the scope of the invention. Similarly, any combination of repositioning, removal, and addition of the engagement portions 195 is possible and within the scope of the invention.

With regard to FIGS. 8-10, the illustrated engagement member 210 is inserted into the passageway 205 of the plug 200 with two engagement portions 220 to engage two of the inner pins 100. The engaged inner pins 100 can be spaced the same or different distances from the pin resting surface 90, and is dependent on the length 222 of the second portions 230 and the length of the end portions 105 of the engaged inner pins 100. Similarly, the inner pins 100 extend different distances into the key slot 80 due to engagement of one or more engagement portions 220 with corresponding inner pins 100.

The engagement member 210 is provided in the plug 200 with a selected set of engagement portions 220, and may be provided with as few as one engagement portion 220, or as many engagement portions 220 as the quantity of inner pins 100 provided in the plug 200. The engagement member 210 that includes the selected set of engagement portions 220 is inserted into the plug 200 so that the selected engagement portions 220 engage the respective inner pins 100. Once the engagement member 210 is inserted into the plug 200, the inner pins 100 and the outer pins 55 can be inserted into the plug 200 and the housing 15, respectively.

The engagement member 210 is removable from the passageway 205, and may be modified to re-key the plug 200. Modification of the engagement member 210 includes one or more of removing, adding, and repositioning one or more undesired engagement portions 220 on the engagement member 210 after removal of the engagement member 210 from the plug 200. Modification of one or more of the engagement portions 220 can change the quantity of inner pins 100 that are engaged by the engagement member 210. For example, removal of one or more engagement portions 220 from the engagement member 210 cause one or more previously spaced inner pins 100 to engage with the pin resting surface 90. Addition of one or more engagement portions 220 to the engagement member 210 cause one or more inner pins 100 originally engaged with the pin resting surface 90 to be spaced a non-zero distance from the pin resting surface 90.

The engagement member 210 can also be modified by removing one or more undesired engagement portions 220 and adding one or more desired engagement portions 220. In some embodiments, the engagement member 210 is removed prior to removing undesired engagement portions 220 and adding desired engagement portions 220. As such, any combination of removal and addition of engagement portions 220 is consistent with the invention and considered herein. The desired engagement portions 220 can be added to the engagement member 210 in the same or different recesses 215 that previously received the undesired engagement portions 220.

The engagement member 210 also can be modified by repositioning one or more engagement portions 220 on the engagement member 210. Repositioning the engagement portions 220 can space one or more previously non-engaged inner pins 100 from the pin resting surface 90, and/or cause one or more previously spaced inner pins 100 to engage the pin resting surface 90. Repositioning the engagement portions 220 includes removing the engagement member 210 from the plug 200, and moving at least one engagement portion 220 that engages an originally engaged inner pin 100 from a first recess 215 on the engagement member 210 to a second recess 215 that is different from the first recess 215. Once one or more engagement portions 220 are moved to new positions on the engagement member 210, the engagement member 210 is re-inserted into the plug 200. Any combination of removal, addition, and repositioning of engagement portions 220 on the engagement member 210 is possible, and is only limited by the quantity of inner pins 100. As such, numerous lock arrangements of the plug 200 are possible using the engagement member 210.

Re-keying the plug 200 and modification of the engagement member also includes replacement of the original engagement member 210 with another (i.e., second) engagement member 210. The first lock arrangement defined by the original engagement member 210 includes originally engaged inner pins 100 that are spaced a distance from the pin resting surface 90. The second lock arrangement defined by the second engagement member 210 includes at least one newly engaged inner pin 100 that is different from the originally engaged inner pins 100. The inner pins 100 engaged by the second engagement member 210, including the at least one newly engaged inner pin 100, are spaced a distance from the pin resting surface 90. The remaining non-engaged inner pins 100 are engaged with the pin resting surface 90.

The operation and modification of the plug 232 and the engagement member 235 illustrated in FIGS. 11-14 is similar to the operation and modification of the plug 200 and the engagement member 210 described with regard to FIGS. 8-10. As such, the operation and modification of the plug 232 and the engagement member 235 will not be discussed herein.

With regard to FIG. 15, the illustrated plug 270 includes one engagement member 280 inserted into one bore 275. Except as described below, operation and modification of the plug 270 and the engagement members 280 are similar to the operation and modification of the plug 20 and the engagement member 130 described with regard to FIGS. 2 and 3. The engaged inner pins 100 can be spaced the same or different distances from the pin resting surface 90, and the distance is dependent on the length of the end portions 105 of the engaged inner pins 100 and the length 292 of the engagement member 280.

The operation and modification of the plug 300 and the engagement member 325 illustrated in FIGS. 19-24 is similar to the operation and modification of the plug 150 and the engagement member 175 described with regard to FIGS. 7A, 7B, and 7C. As such, the operation and modification of the plug 300 and the engagement member 325 will not be discussed herein.

Generally, engagement of the engagement members 130, 175, 210, 235, 280 with the originally-engaged inner pins 100 defines a first lock arrangement of the respective plug 20, 150, 200, 270. When the engagement members 130, 175, 210, 235, 280 are modified, the respective plug 20, 150, 200, 270 is defined by a second lock arrangement that is different from the first lock arrangement. Modification of the engagement members 130, 175, 210, 235, 280 provides many different arrangements of the inner pins 100 with respect to the pin resting surface 90, and with respect to the distance that the inner pins 100 extend into the key slot 80. The first lock arrangement may be used during construction by contractors or others requiring access using a first key. The second lock arrangement may be used after construction by an owner or other similarly situated person that requires access using a second key that is different from the first key. Spacing one or more of the inner pins 100 from the pin resting surface (i.e., extending the inner pins 100 different distances into the key slot) limits undesired access using an improper key (e.g., the first key) because only some of the key engagement portions 115 are engageable by the pin engaging portions 30 of the improper key.

In some constructions, the engagement members 130, 175, 210, 235, 280 are formed from a polycarbonate or thermoplastic material. In other constructions, the engagement members 130, 175, 210, 235, 280 can be formed from a nylon or resilient synthetic polymer material. In still other constructions, the engagement members 130, 175, 210, 235, 280 can be formed from a metal material (e.g., steel, aluminum, etc.).

Various features and advantages of the invention are set forth in the following claims.

What is claimed is:

1. A method of re-keying a lock cylinder, the method comprising:

providing a housing including outer pins, a plug rotatably engaged within the housing and having a key slot and inner pins configured to align with the outer pins, and an engagement member inserted into the plug as a separate piece such that the engagement member engages one or more originally engaged inner pins to space each of the engaged inner pins a distance from a pin resting surface defined by the key slot;

removing the engagement member from the plug;

modifying the engagement member after removing the engagement member from the plug; and inserting the modified engagement member into the plug after modifying the engagement member so that the engagement member engages one or more newly engaged inner pins different from the originally engaged inner pins to space each of the newly engaged inner pins a distance from the pin resting surface.

2. The method of claim 1, wherein modifying the engagement member includes moving an engagement portion of the engagement member from a first position to a second position.

3. The method of claim 1, wherein modifying the engagement member includes removing an engagement portion of the engagement member from the engagement member.

4. The method of claim 3, wherein removing the engagement portion includes replacing the engagement portion with a second engagement portion.

5. The method of claim 1, wherein modifying the engagement member includes adding an engagement portion to the engagement member.

6. The method of claim 1, wherein modifying the engagement member includes replacing the engagement member with a second engagement member that is different from the engagement member.

7. The method of claim 1, wherein engaging the engagement member with one or more originally engaged inner pins includes arranging the originally engaged inner pins in a first arrangement such that each of the inner pins extend a respective first distance into the key slot.

8. The method of claim 7, wherein engaging the engagement member with one or more newly engaged inner pins includes arranging the newly engaged inner pins in a second arrangement different from the first arrangement such that each of the inner pins extend a respective second distance into the key slot.

9. The method of claim 1, further comprising extending the inner pins different distances into the key slot.

10. The method of claim 9, wherein extending the inner pins different distances into the key slot includes engaging the inner pins not engaged by the engagement member with the pin resting surface; and spacing the inner pins engaged by the engagement member one or more distances from the pin resting surface.

11. The method of claim 1, wherein modifying the engagement member includes moving the engagement member from a first passageway within the plug to a second, different passageway within the plug so that the engagement member engages the one or more newly engaged inner pins.

12. The method of claim 1, wherein modifying the engagement member includes replacing the engagement member with a second engagement member having a different length than the engagement member, the method further comprising altering the distance that the engaged inner pin is spaced from the pin resting surface.

13. The method of claim 2, further comprising moving the engagement portion from a first recess in the engagement member to a second recess in the engagement member.

14. The method of claim 13, further comprising inserting another engagement portion into the first recess.

15. The method of claim 1, wherein the engagement member has a first lock arrangement defined by a first engagement portion positioned within a first recess, the method further comprising replacing the engagement member with a second engagement member having a second, different lock arrangement defined by a second engagement portion disposed in a second recess different from the first recess.

16. The method of claim 3, wherein the engagement member includes a second engagement portion, the method further comprising separating the engagement portion from the engagement member without removing the second engagement portion.

17. The method of claim 3, further comprising removing the engagement portion while the engagement member is removed from the plug.

18. The method of claim 1, wherein modifying the engagement member includes removing a first engagement portion of the engagement member from a first recess; and inserting a second engagement portion into the first recess, the second engagement portion having a different diameter or thickness relative to the first engagement portion.

19. A method of re-keying a lock cylinder, the method comprising:

providing a housing including outer pins, a plug rotatably engaged within the housing and having a key slot and inner pins configured to align with the outer pins, and an engagement member inserted into the plug as a separate piece such that the engagement member engages one or more originally engaged inner pins to space each of the engaged inner pins a distance from a pin resting surface defined by the key slot;

removing the engagement member from the plug;

modifying the engagement member while the engagement member is removed from the plug; and inserting the modified engagement member into the plug so that the engagement member engages one or more newly engaged inner pins different from the originally engaged inner pins to space each of the newly engaged inner pins a distance from the pin resting surface.

* * * * *